US008639159B2

(12) United States Patent
Miyazaki

(10) Patent No.: US 8,639,159 B2
(45) Date of Patent: Jan. 28, 2014

(54) COLOR ELECTROPHOTOGRAPHIC IMAGE FORMING APPARATUS

(75) Inventor: Hideki Miyazaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 460 days.

(21) Appl. No.: 12/713,408

(22) Filed: Feb. 26, 2010

(65) Prior Publication Data

US 2010/0221037 A1 Sep. 2, 2010

(30) Foreign Application Priority Data

Mar. 2, 2009 (JP) ..... 2009-048102

(51) Int. Cl.
*G03G 21/18* (2006.01)

(52) U.S. Cl.
USPC ..... 399/112

(58) Field of Classification Search
USPC ..... 399/112, 110, 111, 113–114, 119, 107
See application file for complete search history.

(56) References Cited

U.S. PATENT DOCUMENTS

| | | | | |
|---|---|---|---|---|
| 5,428,426 | A | 6/1995 | Inomata et al. | |
| 5,950,052 | A | 9/1999 | Nomura et al. | |
| 2009/0162095 | A1* | 6/2009 | Yoshimura et al. | 399/114 |
| 2009/0317127 | A1* | 12/2009 | Kishi | 399/110 |
| 2011/0033201 | A1* | 2/2011 | Akutsu et al. | 399/110 |

FOREIGN PATENT DOCUMENTS

| | | | | | |
|---|---|---|---|---|---|
| JP | 02-144569 | A | | 6/1990 | |
| JP | 04-335368 | A | | 11/1992 | |
| JP | 07-295381 | A | | 11/1995 | |
| JP | 10-115961 | A | | 5/1998 | |
| JP | 2002-067278 | A | | 3/2002 | |
| JP | 2005037633 | A | * | 2/2005 | G03G 21/18 |
| JP | 2005-157029 | A | | 6/2005 | |
| JP | 2007-156166 | A | | 6/2007 | |
| JP | 2007213025 | A | * | 8/2007 | |

OTHER PUBLICATIONS

Machine translation of Shiba et al., JP 2005-037633.*

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

A color electrophotographic image forming apparatus for forming a color image on a recording material includes plural cartridge mounting portions for mounting cartridges; a single intermediary transfer member opposed to plural electrophotographic photosensitive member drums, with developed images formed on the drums to be transferred; an image forming unit including the cartridge mounting portions and the intermediary transfer member, the image forming unit being movable between a transfer position for transferring a developed image to the recording material and a mounting and demounting position for mounting and demounting the cartridges relative to the cartridge mounting portions; and a mounting and demounting position locking member for locking the image forming unit to prevent movement to the transfer position relative to a main assembly when at least one of the cartridges is not mounted in a corresponding cartridge mounting portion.

9 Claims, 19 Drawing Sheets

COLOR ELECTROPHOTOGRAPHIC IMAGE FORMING APPARATUS

FIELD OF THE INVENTION AND RELATED ART

The present invention relates to a color electrophotographic image forming apparatus, wherein a plurality of cartridges are dismountably mounted to a main assembly, and an image is formed on a recording material.

Here, the color electrophotographic image forming apparatus forms a color image on the recording material using an electrophotographic image forming process. The examples of the color electrophotographic image forming apparatus include a color electrophotographic copying machine, a color electrophotographic printer (color laser beam printer, color LED printer, for example), a color facsimile device, and a color word processor. The image is formed by the electrophotographic image forming apparatus on a recording material, and the recording material is paper or an OHP sheet, for example. The cartridge is a process cartridge, a developing cartridge or the like and contributes to an image forming process for forming the image on the recording material in the state that it is mounted to the main assembly of the electrophotographic image forming apparatus. Here, the process cartridge contains at least one of the charging means, developing means, and cleaning means as process means, and the electrophotographic photosensitive drum as a unit integrally, and it is dismountably mountable to the main assembly. The process cartridge may contain the developing means as the process means and the electrophotographic photosensitive drum as a unit, and it is dismountably mounted to the main assembly of the electrophotographic image forming apparatus. The process cartridge may contain the charging means, the developing means, or the cleaning means as the process means and the electrophotographic photosensitive drum as a unit, and it is dismountably mounted to the main assembly. The process cartridge which is provided integrally with the electrophotographic photosensitive drum and the developing means is called an integral-type process cartridge. The process cartridge which is provided integrally with the electrophotographic photosensitive drum and the process means other than the developing means is called a discrete type process cartridge. In this case, the developing means is provided in a developing unit not integrally with the process cartridge, and the discrete type process cartridge forms the image using the combination with such a developing unit. The process cartridge is mounted and demounted relative to the main assembly by a user. For this reason, the maintenance of the apparatus is easy. The process means acts on the electrophotographic photosensitive drum. The developing cartridge is provided with a developing roller, and an electrostatic latent image formed on the electrophotographic photosensitive drum is developed by the developing roller. It contains a developer (toner) for the development, and is dismountably mounted to the main assembly. In the case of the developing cartridge, the electrophotographic photosensitive drum is mounted to the main assembly or a cartridge supporting member. Or, the electrophotographic photosensitive drum is provided in a so-called discrete type process cartridge. In this case, the process cartridge is not provided with the developing means. The developing cartridge is also mounted and demounted relative to the main assembly by the user. For this reason, the maintenance of the device is easy. Therefore, the cartridge in this invention includes the process cartridges of a so-called integral type or a so-called discrete type. The cartridge includes the combination of the so-called process cartridge of the discrete type and the developing cartridge. In another example of the cartridge, the electrophotographic photosensitive drum is mounted fixedly to the main assembly or the cartridge supporting member and the detachably mountable developing cartridge act on the electrophotographic photosensitive drum. As has been described hereinbefore, the electrophotographic image forming apparatus for forming the image on the recording material using the electrophotographic image forming process is known. In this electrophotographic image forming apparatus, the process cartridge type described above is known. In addition, the developing cartridge type which comprises only the developing unit that is not integral with the photosensitive drum is known. In the present invention, the process cartridge type and the developing cartridge type are usable. The process cartridge and the developing cartridge are provided with a developer accommodating portion which contains the developer (toner) for developing the electrostatic latent image.

A color electrophotographic image forming apparatus is known (U.S. Pat. No. 5,428,426) which includes an intermediary transfer drum as an intermediary transfer member, wherein the cartridges each including a developer and a photosensitive drum are provided therearound. With this structure, in mounting the process cartridge in the main assembly, the photosensitive drum is positioned relative to the intermediary transfer drum, and therefore the mounting and demounting of the process cartridge are easy.

SUMMARY OF THE INVENTION

The present invention further develops the conventional structure described above. It is a principal object of the present invention to provide a color electrophotographic image forming apparatus with which the mounting operativity upon mounting and dismounting a cartridge to a main assembly of the color electrophotographic image forming apparatus is improved.

According to an aspect of the present invention, there is provided a color electrophotographic image forming apparatus for forming a color image on a recording material comprising a plurality of cartridge mounting portions for demountably mounting cartridges; a single intermediary transfer member provided opposed to said electrophotographic photosensitive member drums, wherein developed images formed on said electrophotographic photosensitive member drums are to be transferred; an image forming unit including said cartridge mounting portions and said intermediary transfer member, wherein said image forming unit is movable between a transfer position for transferring to the recording material a developed image transferred onto said intermediary transfer member from said electrophotographic photosensitive member drums and a mounting and demounting position for mounting and demounting said cartridges relative to said cartridge mounting portions; and a mounting and demounting position locking member for locking said image forming unit in the mounting and demounting position relative to a main assembly of said color electrophotographic image forming apparatus when at least one of said cartridges mounted to said cartridge mounting portions is removed in a state in which image forming unit is placed in the mounting and demounting position.

According to the present invention the operativity at the time of mounting and demounting the cartridge on the main assembly is improved.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

The preferred embodiments of the present invention will be described in conjunction with the accompanying drawings. The dimensions, the materials, the configurations, the relative positions, and so on of the constituent parts which will be described hereinafter may be properly changed by one skilled in the art depending on the structures and the various conditions of a device to which this invention is applied, and the scope of this invention is not limited to specific dimensions, materials, configurations, relative positions and so on of the embodiments which will be described below.

Embodiment 1

Figure 1:
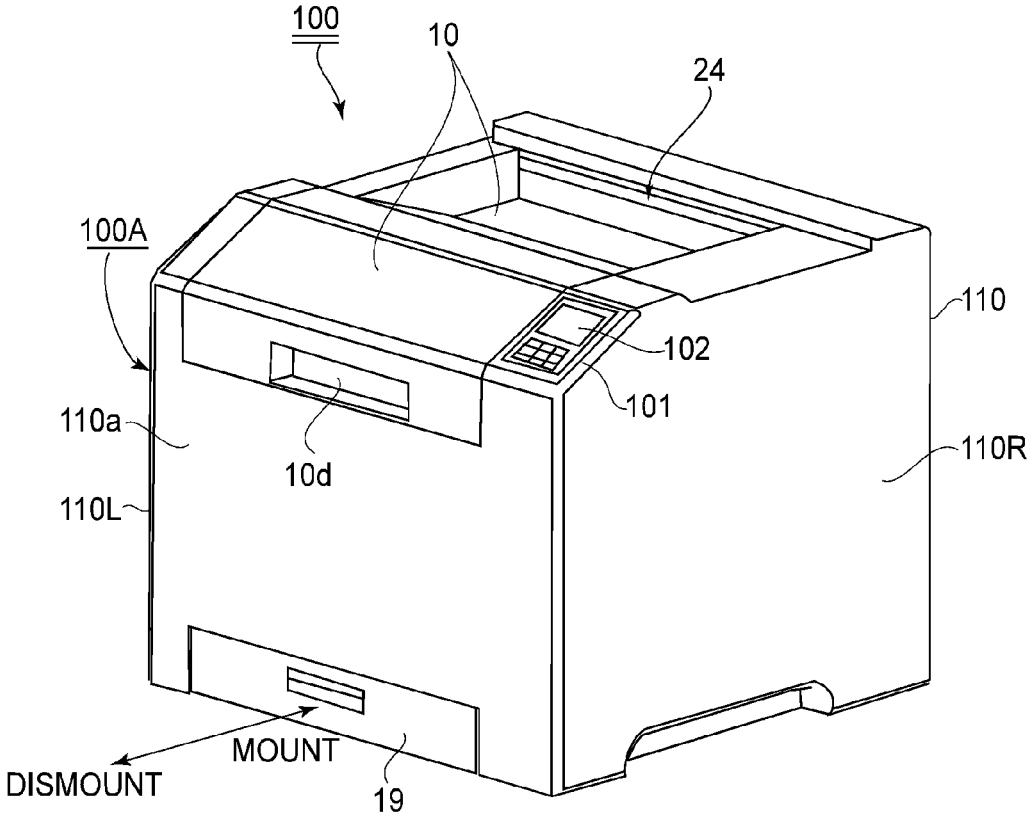
FIG. 1 is an outer appearance perspective view of the image forming apparatus of Embodiment 1.
Figure 2A:
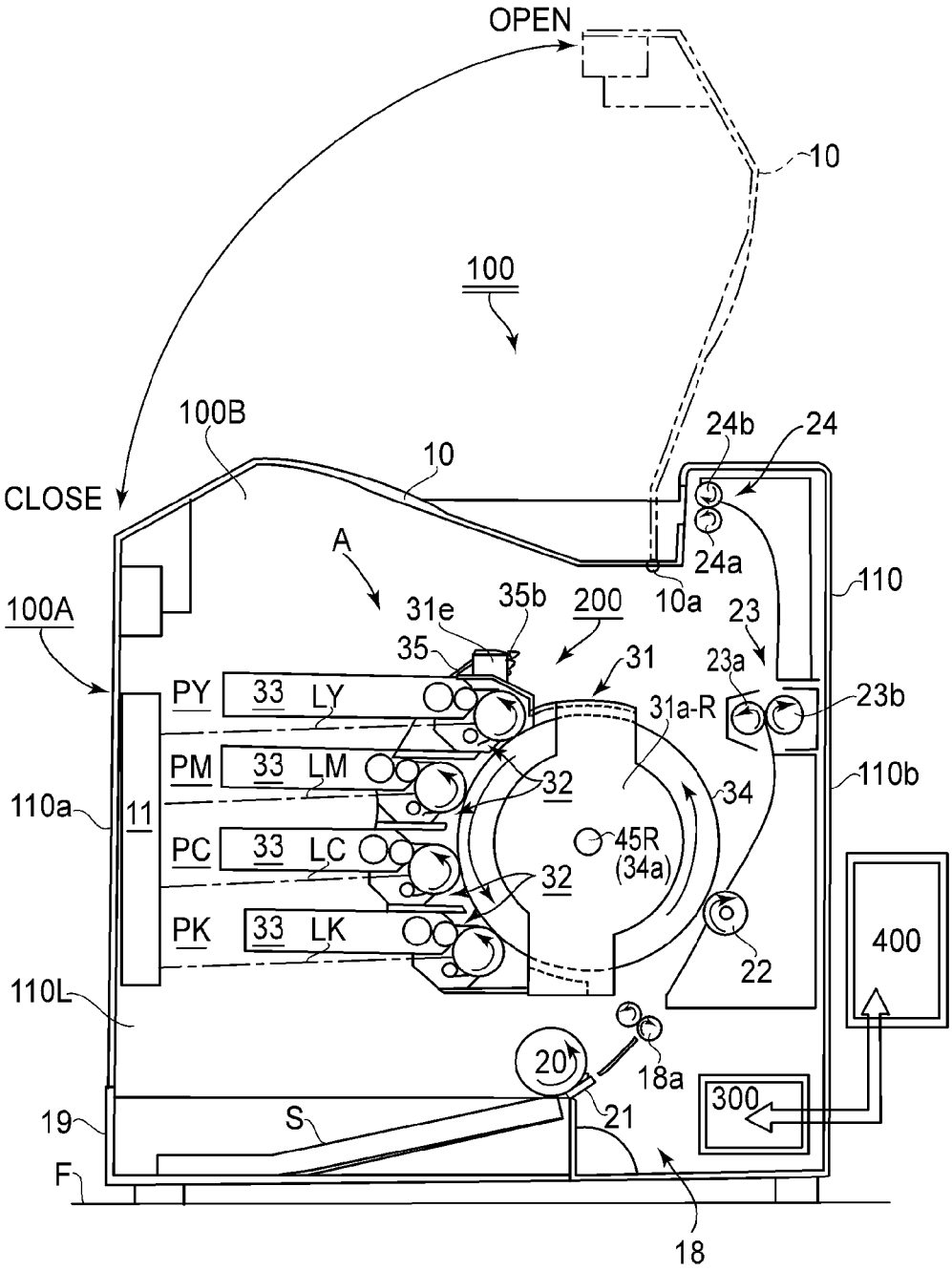
FIG. 2A is a schematic right side sectional view of the image forming apparatus of FIG. 1.
Figure 2B:
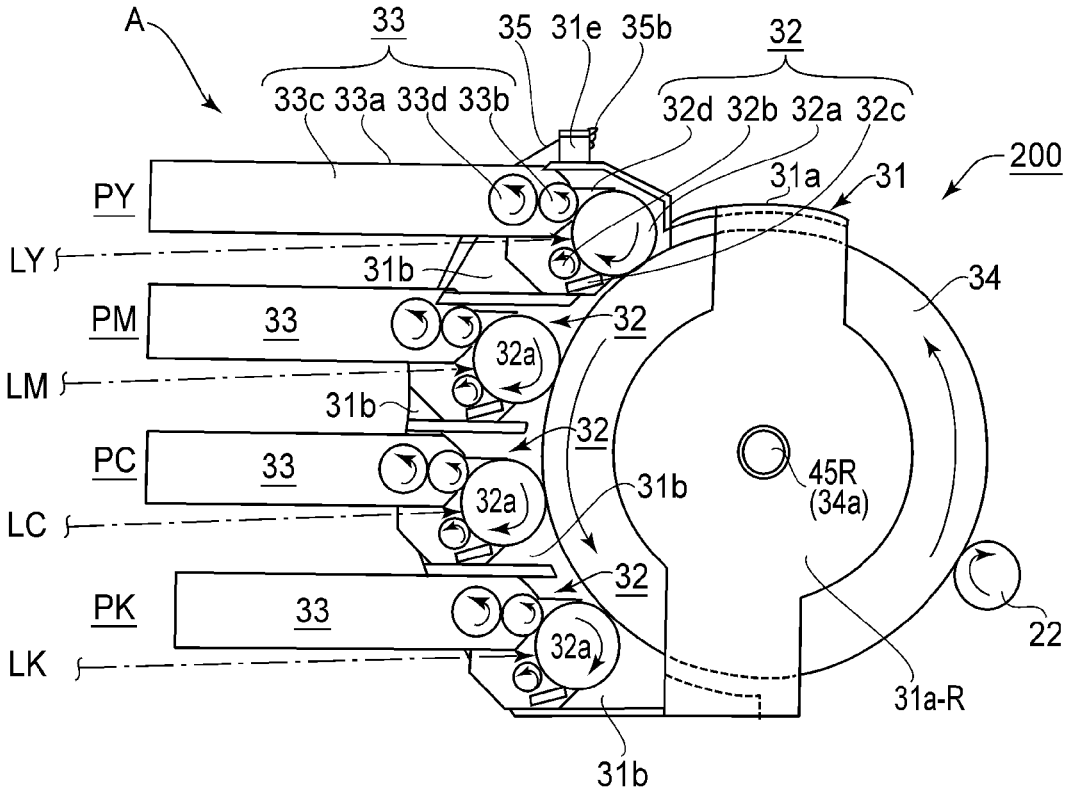
FIG. 2B is a partial enlarged view of a part of FIG. 2A.
Figure 3:
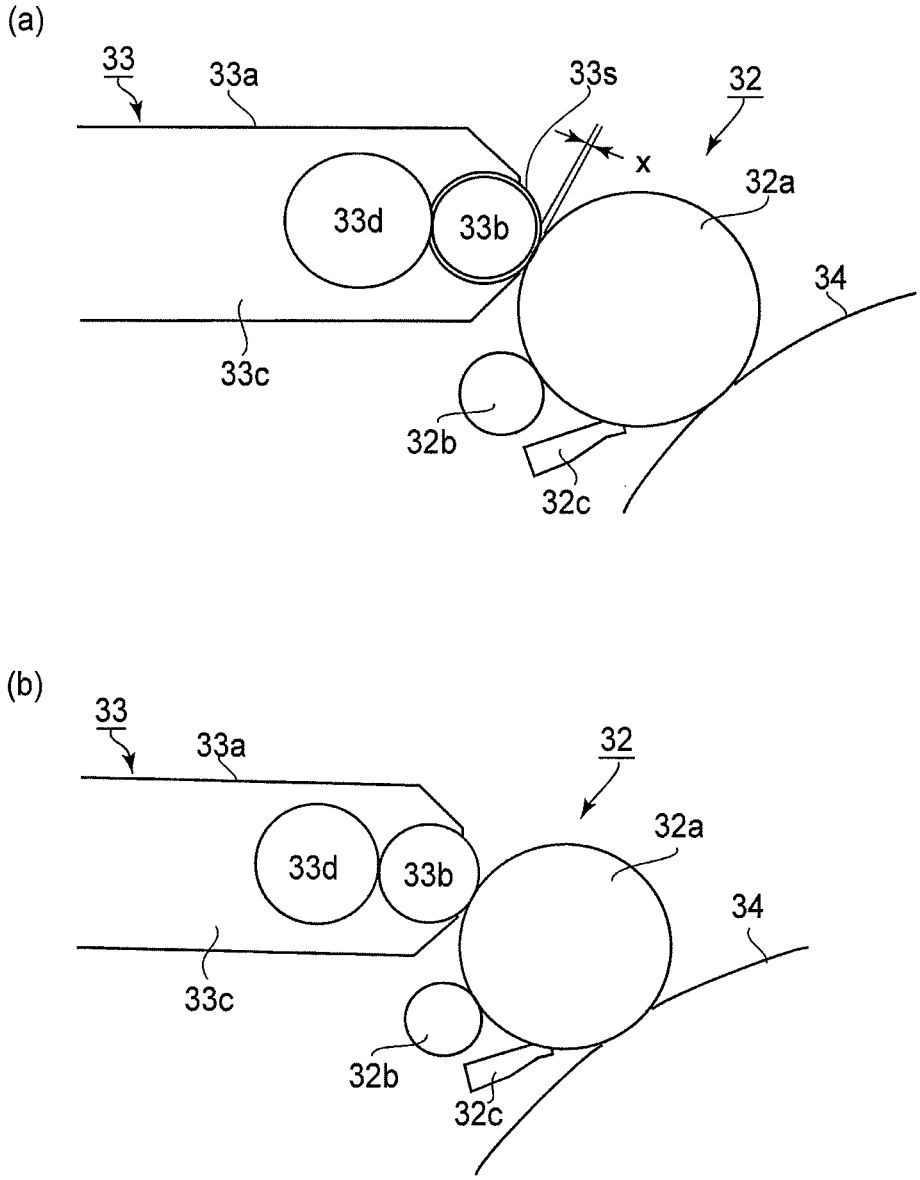
In FIG. 3, (a) is a schematic view of a non-contact type developing system, and (b) is a schematic view of a contact type developing system.

FIG. 1 is an outer appearance perspective view of the color electrophotographic image forming apparatus (image forming apparatus) 100 according to this embodiment. FIG. 2A is a right side longitudinal sectional view of the image forming apparatus 100. The image forming apparatus 100 is a laser printer of a full-color type which uses the electrophotographic process. In more detail, the image forming apparatus 100 forms a full-color image on a recording material (paper) S on the basis of an electrical image signal inputted to a control circuit portion 300 from an external host device 400 of a personal computer, an image reader, a receiving part of a facsimile device or the like. In the following descriptions of the image forming apparatus 100, a front side is a side, wherein a feeding cassette 19 which stacks a recording material S is drawn. A backside is the opposite side from it. An upper side is a side where a maintenance cover 10 is opened. Front-rear directions are a direction to the front side from the backside of the image forming apparatus and the reverse direction thereof. The left and right are the left and right, as seen from the front side of the image forming apparatus. The left-right directions are a direction to the left from the right, and the reverse direction thereof. A main assembly 100A is a portion of an image forming apparatus other than the cartridge. The image forming apparatus 100 is placed on a substantially horizontal installation surface F such as a mounting base, the desk or floor. The main assembly 100A includes an image forming unit 200. FIG. 2B is an enlarged view of a unit 200 portion of the image forming apparatus 100 shown in FIG. 2B. The unit 200 is provided with a plurality of cartridges 33 and a single intermediary transfer member 34 (in this embodiment four process cartridges P (PY, PM, PC, PK)). In the image forming apparatus 100, a plurality of cartridges 33 are dismountably mounted to main assembly 100A, and a color image is formed on recording material S. The unit 200 will be described in the detail hereinafter. In this embodiment, each process cartridge (cartridge) P is a discrete type which includes a photosensitive unit 32 and developing cartridge 33 as a pair. Each cartridge P has a similar structure except in having different color developers (toner) contained in the developing cartridges 33. In this embodiment, although the cartridge is a separation type developing cartridge, the present invention is not limited to this. The photosensitive unit 32 is provided with an electrophotographic photosensitive drum photoconductivity member (drum type, hereinafter, drum) 32*a*. The unit 32 includes the charging roller 32*b* and the cleaning blade 32*c* for removing the developer which remained on the surface of the drum 32*a*, as the process means which acts on the drum 32*a*. The drum 32*a*, the charging roller 32*b*, and the cleaning blade 32*c* are assembled in predetermined arrangement relations relative to a photosensitive member case 32*d*. The developing cartridge 33 is provided with a developing device case 33*a* and a developing roller 33*b*, provided at one end portion of this case 33*a*, for developing an electrostatic latent image formed on the drum 32*a* into a developer image by supplying the developer to the drum 32*a*. The cartridge 33 includes the developing device 33*c* as the developer accommodating portion for accommodating the developer to be used for a development of the electrostatic latent image and a supplying roller 33*d* for supplying the developer from the developing device 33*c* to the developing roller 33*b*. A first cartridge PY accommodates a yellow (Y) developer in the developing device 33*c* of the cartridge 33, and forms a Y color developer image on the surface of the drum 32*a*. A second cartridge PM accommodates a magenta (M) developer in the developing device 33*c* of the cartridge 33, and forms an M color developer image on the surface of the drum 32*a*. A third cartridge PC accommodates a cyan (C) developer in the developing device 33*c* of the cartridge 33, and forms a C color developer image on the surface of the drum 32*a*. A fourth cartridge PK accommodates a black (K) developer in the developing device 33*c* of the cartridge 33, and forms a K color developer image on the surface of the drum 32*a*. In this embodiment, the intermediary transfer member 34 is a cylindrical drum (intermediary transfer drum) that horizontally extends along an axis of a rotation axis 34*a*. Each cartridge 33 is provided on a front side of the transfer member 34, and extends substantially parallel with the installation surface F of the main assembly 100A. They are provided adjacent to each other with respect to the substantially vertical direction. In the image forming apparatus of this embodiment, the first cartridge PY takes a top most stage position, and the second cartridge PM is placed therebelow. The third cartridge PC is placed further below. The fourth cartridge PK takes a bottom most stage position. As shown in (a) of FIG. 3, the developing roller 33*b* of each cartridge P may be spaced by a predetermined small gap (predetermined distance) x from the drum 32*a*, as a non-contact developing system. As shown in (b) of FIG. 3, it may be in contact with the drum 32*a*, as a contact type developing system. In the non-contact type developing system of (a), in order to maintain the predetermined gap x, the spacers 33*s* provided on the left and right end portions of the developing roller 33*b* are contacted to the drum 32*a*. The front side of each cartridge P is provided with a laser scanner unit 11 as an image exposure device. The unit 11 is disposed between a front frame 110*a* of a main frame 110 which is a frame of the main assembly and the cartridges P, in the main assembly 100A. The unit 11 includes a laser diode, a polygonal mirror, an Fθ lens, a reflection mirror, and so on. The unit 11 outputs laser beams L (LY, LM, LC, LK) which are modulated correspondingly to the image information for the Y, M, C, K color inputted to the control circuit portion 300 from the external host device 400 to scan the drums 32*a* of the cartridges P for the corresponding colors (image exposure). A lower part of the unit 200 includes a feeding unit 18. The feeding unit 18 includes a feeding cassette 19 for stacking recording material S, a feeding roller 20, a separation pad 21, and so on. The cassette 19 can go into and out of the front side of the main assembly 100A (front loading). In the main assembly 100A, between the transfer member 34 and a rear frame 110*b* of the main frame 110A, there is provided an upper recording material feeding path extended from the feeding roller 20 to the upper rear portion in the main assembly 100A. A registration roller couple 18*a*, a secondary transfer roller 22, a fixing device 23, and a discharging roller pair 241*s* are provided vertically along this feeding path. The fixing device 23 includes a fixing film unit 23*a* and a pressing roller 23*b*. The discharging roller pair 24 includes a discharging roller 24*a* and a discharging roller 24*b*.

An upper surface of the main assembly 100A is provided with a maintenance cover 10 which functions as a discharging tray for receiving a recording material S on which the image has been formed. The cover 10 opens and closes an opening 100B provided in the upper surface of the main assembly 100A (opening and closing member). A rear side of the cover 10 is rotatably coupled through a hinge shaft 10*a* to the main assembly 100A. The cover 10 is movable between the closed position for closing a top opening 100B of the main assembly 100A and the open position for opening the opening portion 100B. The cover 10 is an opening and closing member for opening and closing the opening 100B in the upper portion of the main assembly 100A about the hinge shaft 10*a*. A user touches the fingers on a grip portion 10*d* provided on a front side of the cover 10, and an opening and closing of the cover 10 is effected manually. Through the opening 100B, as will be described hereinafter, the developing cartridge is mounted and demounted relative to a developing cartridge mounting portion 31*c* of the unit 200 placed in the mounting and dismounting position. In the state of FIGS. 2A and 2B, a drive inputting portion (unshown) of the transfer member 34 of the unit 200 is coupled with a drive outputting portion (unshown) of a main assembly (100A). The drive inputting portions (unshown) of a photosensitive unit 32 and the developing cartridge 33 of each cartridge couple with the drive outputting portions (unshown) provided in the main assembly 100A, respectively. The electrical contacts (unshown) of the photosensitive unit 32 and the developing cartridge 33 of each cartridge P are electrically connected with an electric power supply system (unshown) of the main assembly (100A). The driving force transmission system and a bias voltage application system of the transfer member 34 and each cartridge P are not illustrated, for the sake of simplicity, since they may be the same as those in the ordinary image forming apparatus.

The operation for forming a full-color image will be described. The drum 32*a* of each cartridge P is rotationally driven at a predetermined controlled speed in a clockwise direction indicated by an arrow in FIG. 2B. The charging roller 32*b* is rotated by the rotation of the drum 32*a*. The transfer member 34 is rotationally driven at the speed corresponding to the speed of the drum 32*a* in the counterclockwise direction (codirectional with the rotation of the drum 32*a*) of the arrow. In the cartridge 33, the developing roller 33*b* and the supplying roller 33*d* are rotationally driven at a predetermined controlled speed in the counterclockwise direction of the arrow. The scanner unit 11 also is driven. In synchronism with this drive, a predetermined charging bias voltage is applied to the charging roller 32*b* at the predetermined controlled timing in each cartridge P. By this, the surface of the drum 32*a* is uniformly charged by the charging roller 32*b* to the predetermined polarity and predetermined potential. In each cartridge P, the electrostatic latent image formed on the surface of the drum 32*a* is developed into a developer image by the developing roller 33*b* of the developing cartridge 33. The developing roller 33*b* is supplied with a predetermined developing bias voltage at the predetermined controlled timing. Through the above-described electrophotographic image forming process operation, a Y color developer image corresponding to a yellow component of the full-color image is formed on the drum 32*a* of the first cartridge PY. The developer image is transferred (primary transfer) onto the transfer member 34 in a primary transfer nip which is the contact portion between the drum 32*a* and the intermediary transfer member 34. An M color developer image corresponding to a magenta component of the full-color image is formed on the drum 32*a* of the second cartridge PM. The developer image is transferred (primary transfer) onto the transfer member 34 in a primary transfer nip which is the contact portion between the drum 32*a* and the transfer member 34 superimposedly on the already transferred Y color developer image. On the drum 32*a* of the third cartridge PC, a C color developer image corresponding to a C color component of the full-color image is formed. The developer image is transferred (primary transfer) onto the transfer member 34 in the primary transfer nip which is the contact portion between the drum 32*a* and the intermediary transfer member 34 superimposedly on the already transferred Y color+M color developer image. A K color developer image corresponding to a black component of the full-color image is formed on the drum 32*a* of the fourth cartridge PK. The developer image is transferred (primary transfer) onto the transfer member 34 in the primary transfer nip which is the contact portion between the drum 32*a* and the intermediary transfer member 34 superimposedly on the already transferred Y color+M color+C color developer images. In this way, a full-color developer image of the Y color+M color+C color+K color is synthetically formed on the transfer member 34. The order of the colors of the developer images sequentially superimposedly transferred onto the transfer member 34 is not limited to the above described order.

The untransferred developer remaining on the drum surface after the primary transfer of the developer image relative to the transfer member 34 is removed by the cleaning blade 32*c* in each cartridge. On the other hand, the feeding roller 20 is driven at the predetermined controlled timing. In this manner, by a cooperation of the feeding roller 20 and the separation pad 21, the separation and feeding of the sheet-like recording materials S stacked in the cassette 19 is carried out one by one. The recording material S is introduced into the secondary transfer nip which is the contact portion between the transfer member 34 and the secondary transfer roller 22, at the predetermined controlled timing by the registration roller couple 18*a*. The secondary transfer roller 22 is supplied with the secondary transfer bias voltage of the predetermined potential having the polarity opposite to that of the charge polarity of the developer at the predetermined controlled timing. By this, while the recording material S is nipped and fed by the secondary transfer nip, the developer image on the intermediary transfer member 34 on which it is superimposed is sequentially transferred (secondary transfer) onto the surface of recording material S. The recording material S which passed the secondary transfer nip is separated from the surface of the transfer member 34 and is introduced into the fixing device 23 in which it is heated and pressed by a fixing nip. By this, the color developer images are mixed and fixed on recording material S. The recording material S is discharged out of the fixing device 23, and is discharged on the cover 10 which functions as a discharging tray by discharging roller pair 24 as a full-color print. In the case of this embodiment, the toner remaining after the secondary transfer on the surface of the transfer member after the separation of the recording material 34 is electrostatically deposited on the surface of the drum 32*a* in the primary transfer nip of the first cartridge PY, for example, and it is removed by the cleaning blade 32*c*. In the case of a monochromatic image forming mode, only the fourth cartridge PK for forming a black K image is used. In this embodiment, the secondary transfer roller 22 is movable between a first position in which it contacts the transfer member 34 and forms the secondary transfer nip and a second position spaced from the transfer member 34 by a shifting mechanism (unshown). At the time of an image forming operation of the image forming apparatus 100, the secondary transfer roller 22 is moved to the first position, and at the time of then on-image formation, it is moved to the second position. The transfer roller 22 may normally be contacted with the intermediary transfer member 34.

(Image Forming Unit)

Figure 4A:
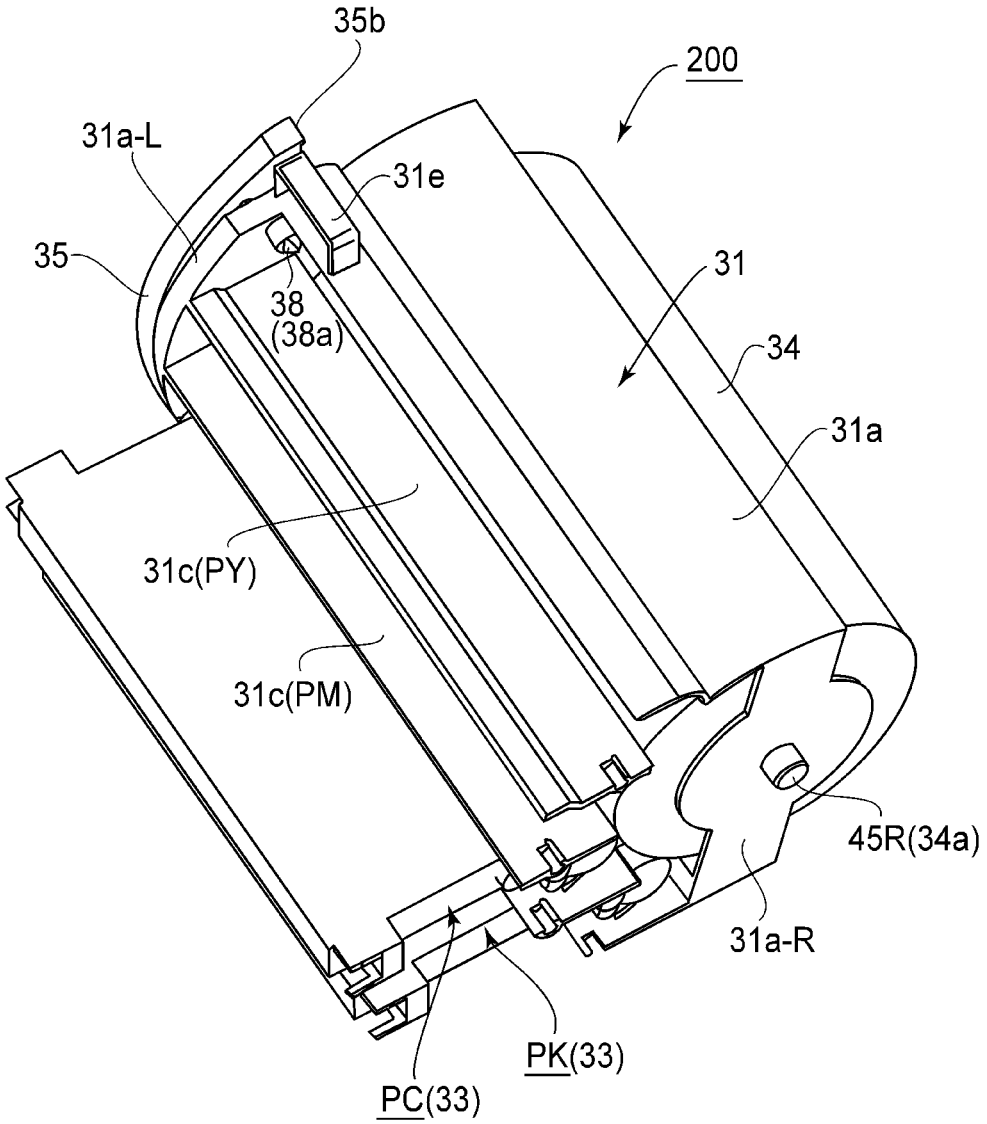
FIG. 4A is a right-hand side outer appearance perspective view of an image forming unit in the state that the developing cartridges of the first and second cartridges are dismounted.
Figure 4B:
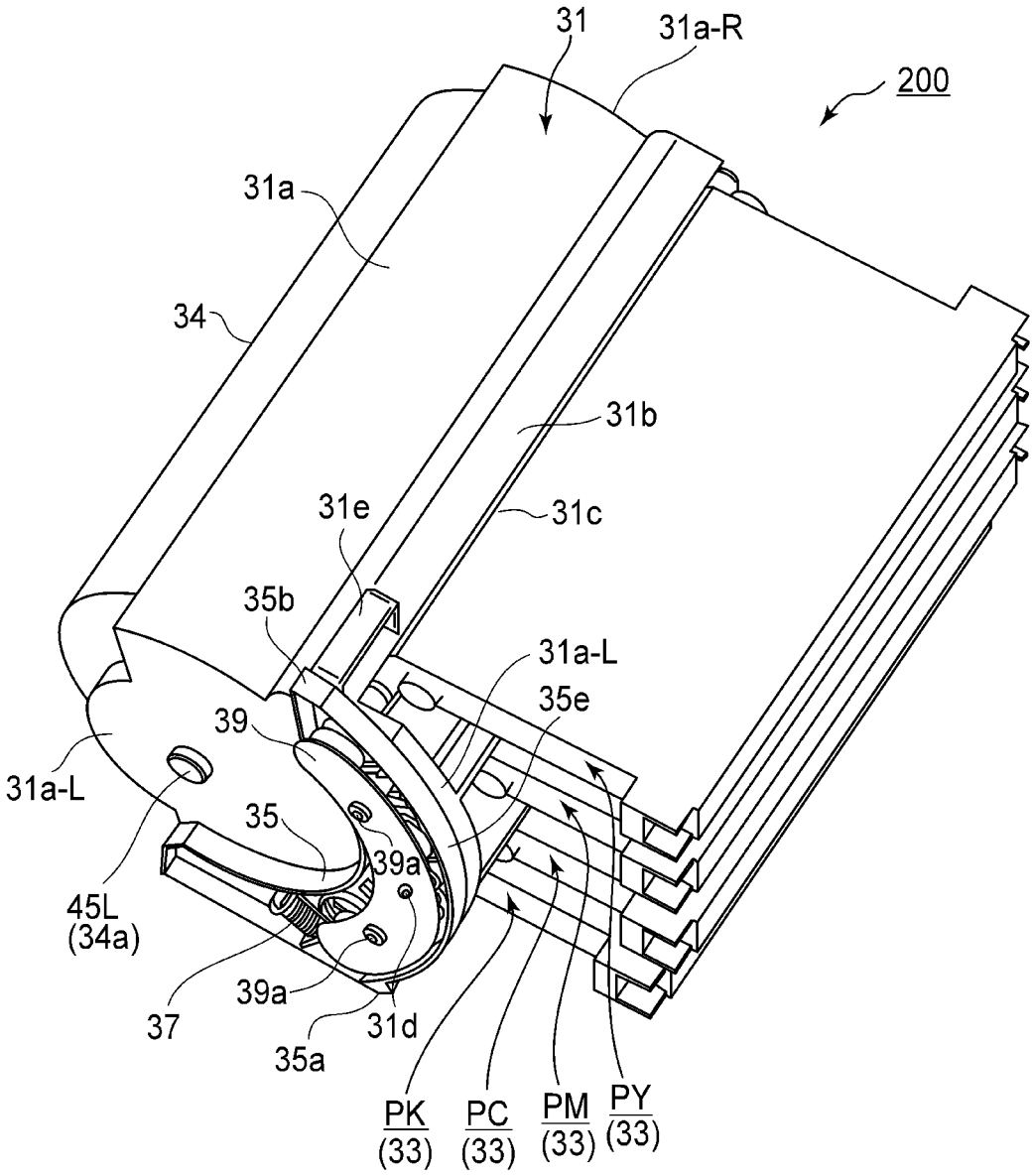
FIG. 4B is a left-hand side outer appearance perspective view of the image forming unit.
Figure 5A:
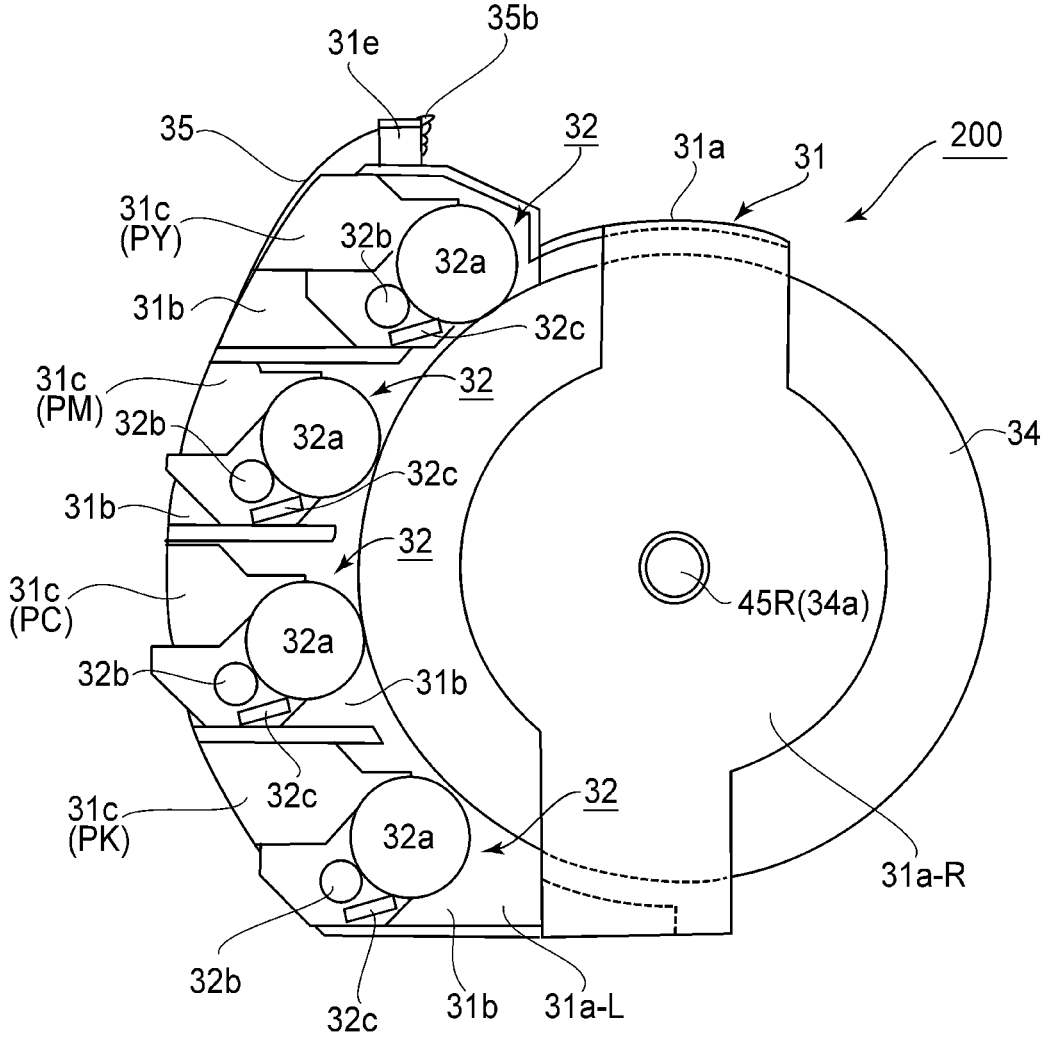
FIG. 5A shows a right side view of the image forming unit in the state that all the developing cartridges 33 are dismounted from the respective mounting portions.
Figure 5B:
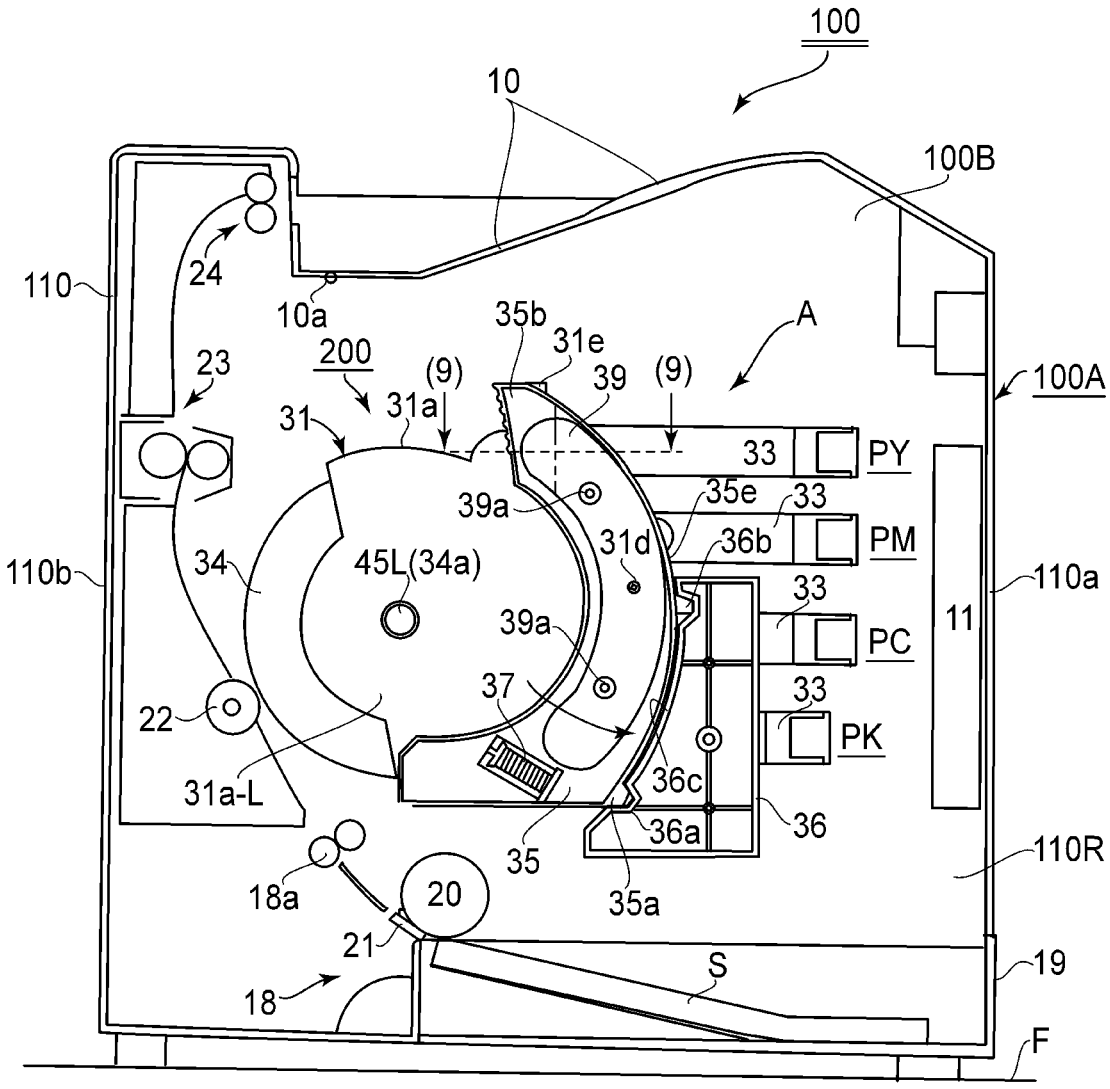
FIG. 5B is a left-hand side longitudinal sectional view of the image forming apparatus.

FIG. 4A is a right-hand side outer appearance perspective view of the image forming unit 200. In FIG. 4A, the developing cartridge 33 of the first cartridge PY and the developing cartridge 33 of the second cartridge PM are dismounted from the respective mounting portions 31*c*. FIG. 4B is a left-hand side outer appearance perspective view of the unit 200. FIG. 5A is the right side view of the unit 200 in the state where all the cartridges 33 are dismounted from the respective mounting portion 31*c*. FIG. 5B is a left side longitudinal sectional view of the image forming apparatus 100. The unit 200 has the sub-frame 31 which is rotatably supported between the left-hand side frame 110L and the right-hand side frame 110R. The frame 31 is provided with an intermediary transfer frame 31*a* rotatably supporting the transfer member 34. The transfer member 34 is provided with a shaft (rotation axis) 34*a*, and the left-hand end portion and right-hand end portion thereof are supported rotatably between a left side plate 31*a*-L of the frame 31*a* and a right side plate 31*a*-R thereof. Outer sides of the left side plate 31*a*-L and the right side plate 31*a*-R are provided with a left shaft portion 45L and a right shaft portion 45R co-axial with the center axis 34*a* of the frame 31*a*, respectively. The sub-frame 31 is provided with a photosensitive member supporting unit 31*b* (FIG. 2B and FIG. 5B) for supporting the photosensitive unit 32 of each cartridge P. A photosensitive member case 32*d* of the photosensitive unit 32 is coupled to a unit 31*b*. By this, a photosensitive drum 32*a* is in contact, with a predetermined urging force, to the transfer member 34. The sub-frame 31 is provided with the cartridge mounting portions 31*c* (FIG. 5A) for mounting the cartridge dismountably. In this embodiment, the cartridge mounting portions 31*c* are the developing cartridge mounting portions (developing device coupling unit for tentatively holding developing cartridges 33) for mounting the first to fourth cartridges P dismountably. A mounting portion 31*c* has such a guiding configuration that the cartridge 33 is coupled to the photosensitive unit 32 mounted to the unit 31*b*. The developing device case 33*a* of the cartridge 33 is coupled to the mounting portion 31*c*. A handle 31*e* is provided in the left-hand end portion of the upper surface of the frame 31. The locking lever 35 is provided at the outer side of left side plate 31*a*-L of the frame 31. The lever 35 is provided swingably about the boss 31*d* implanted to the outer surface of left side plate 31*a*-L. The front side 35*e* of the lever 35 is formed into a convex surface having a center at the shaft portion 45L, and extends from the bottom side to the top side of the sub-frame 31. A boss 31*d* is positioned in the substantially central portion with respect to the up-down direction of the lever 35. A bottom end of the front side 35*e* of the lever 35 is provided with a projection 35*a*. A top end 35*b* of the lever 35 is in the position of a grip portion 31*d* of the sub-frame 31. The lever 35 is normally urged to the counterclockwise direction indicated by the arrow rotationally about the boss 31*d* in FIG. 5B, by a spring force of a compression spring 37 compressed between the lever 35 and the left side plate 31*a*-L.

Figure 8A:
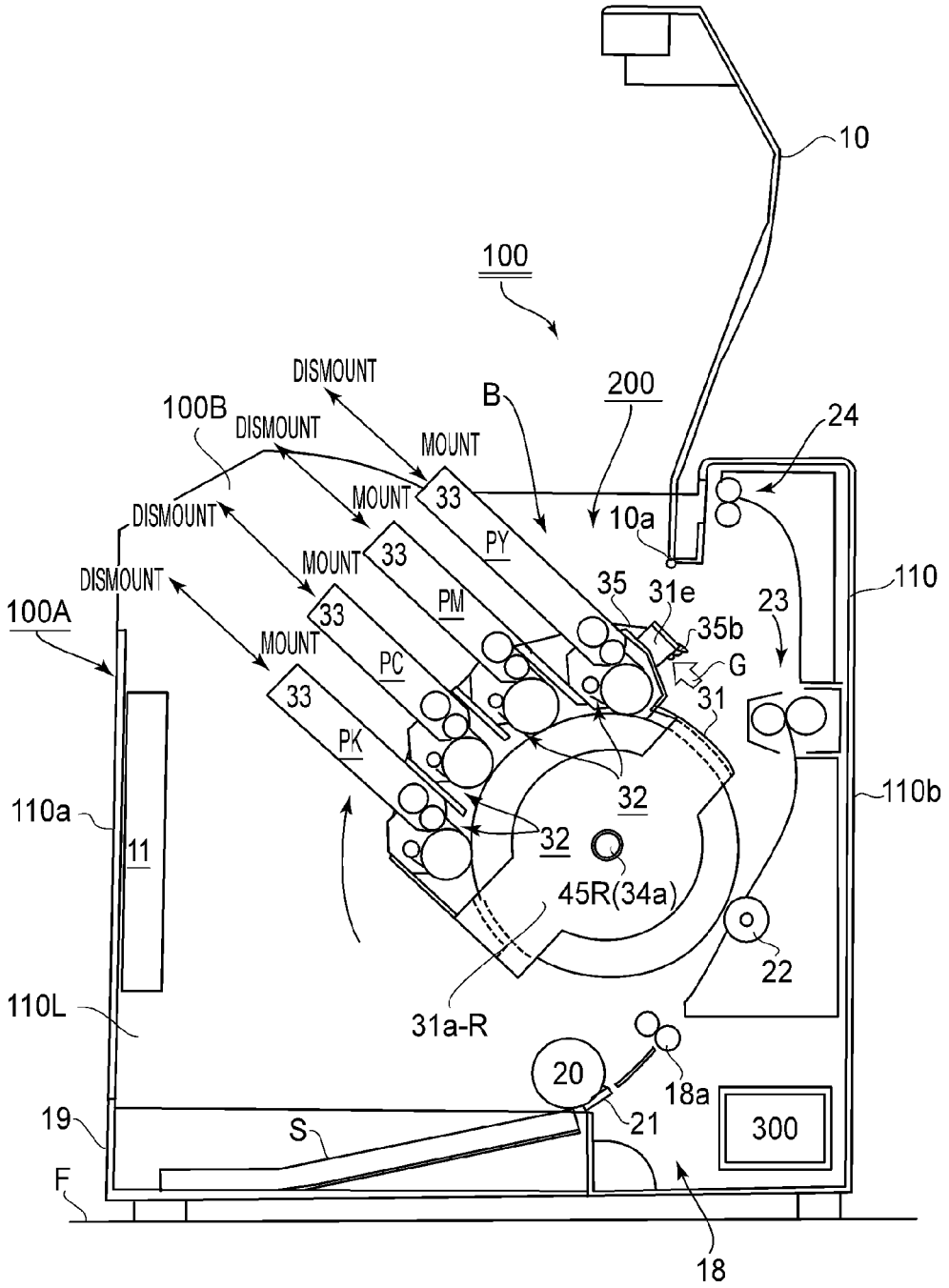
FIG. 8A is a right side longitudinal sectional view of the image forming apparatus in the state that the image forming unit is in a mounting and dismounting position.

The left shaft portion 45L and the right shaft portion 45R of the unit 200 are supported rotatably by the bearing portions (unshown) provided on a left frame (110L) and a right (110R), respectively. More particularly, the unit 200 is rotatable about the shaft portions 45L, 45R, i.e., a rotational center 34*a* of the intermediary transfer member 34, in the main assembly 100A. By this, as shown in FIG. 2B, the unit 200 is movable between the transfer position (first orientation) and the mounting and dismounting position (second orientation) B as shown in FIG. 8A. The transfer position A is the position for transferring the developer image transferred onto the transfer member 34 from the drum 32*a* onto the recording material S. Here, the mounting and dismounting position B is the position for mounting and demounting the cartridge 33 relative to the mounting portion 31*c*. In the state that the unit 200 is placed in the transfer position A, as shown in FIG. 5A, the projection 35*a* of the locking lever 35 is in engagement with a first recess 36*a* of a locking base 36 fixed to a stationary member of the main assembly (100A) side. By this, the unit 200 is locked to the main assembly 100A in the transfer position A (locking). According to this embodiment, the projection 35*a* of the locking lever 35 and the first recess 36*a* of a locking base 36 are a transfer position locking means for locking the unit 200 to the main assembly 100A in the transfer position A. The base 36 is provided with a concave surface 36*c* opposed to an arcuate surface of the front side 35*e* of the lever 35. The bottom end of the concave surface 36*c* is provided with the first recess 36*a*, and a top end thereof is provided with a second recess 36*b*. As for the lever 35, the projection 35*a* of the bottom end is normally rotationally urged about the boss 31*d* toward the base 36 by the spring force of the compression spring 37.

Figure 6A:
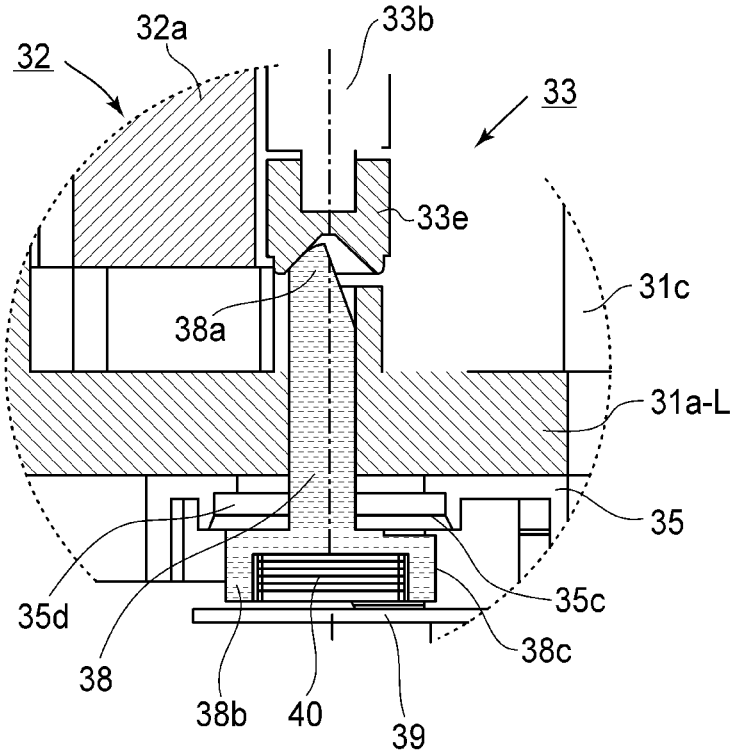
FIG. 6A is an enlarged cross-sectional view taken along (9)-(9) of FIG. 5B.

FIG. 6A shows an enlarged cross-sectional view taken along (9)-(9) of FIG. 5B. Designated by 38 is a plunger 38 supported to be linearly movable by a left side plate portion corresponding to the mounting portion 31*c* of the frame 31. Designated by 33*e* is a development bearing for supporting the developing roller 33*b* pivotally by the developing device case 33*a*. The plunger 38 is pressed and urged toward the developing cartridge 33 by a compression spring 40 provided between a confinement plate 39 fixed to the lever 35 by a screw 39*a* and the plunger 38. In the state that the cartridge 33 is mounted to the mounting portion 31*c*, a free end portion 38*a* of the plunger 38 presses an inclined surface of a development bearing 33*e*. As shown in FIG. 3A, the spacers 33*s* of the developing roller 33*b* are in contact to the drum 32*a*, or, as shown in FIG. 3B, by this, the developing roller 33*b* is in contact to the drum 32*a*. In more detail, the cartridge 33 is positioned in the predetermined relation relative to the mounting portion 31*c* to be stably supported. The positioning structure for the cartridge 33 which includes the plunger 38, the compression spring 40, and the confinement plate 39 is provided in the mounting portion 31*c* of each cartridge P. By this, each cartridge 33 is positioned in predetermined relation to the corresponding mounting portion 31*c*, and is stably supported.

(Exchanging System of Developing Cartridge)

Figure 6B:
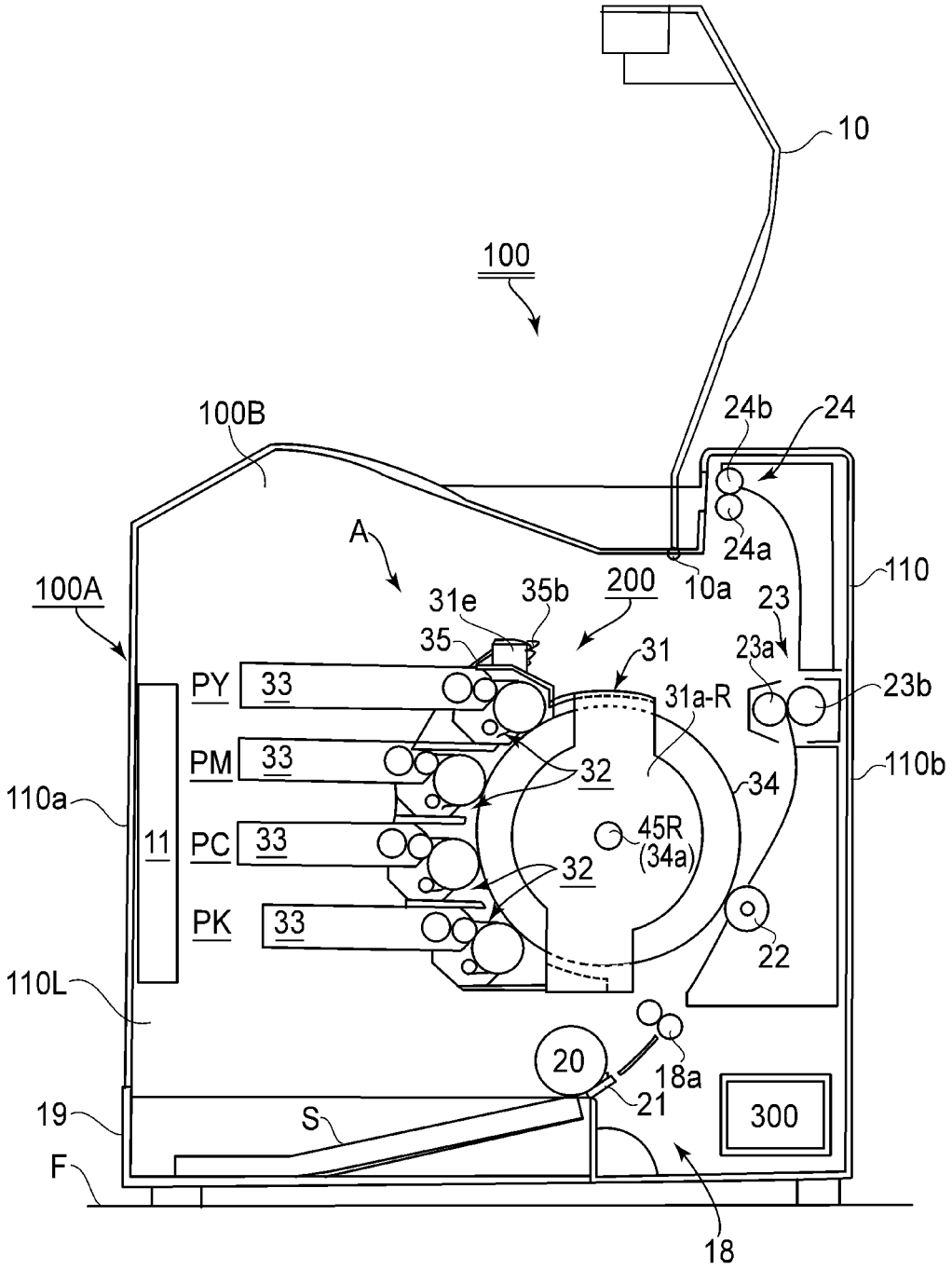
FIG. 6B is a right side longitudinal sectional view of the image forming apparatus in the state that a cover is in an open position.
Figure 7A:
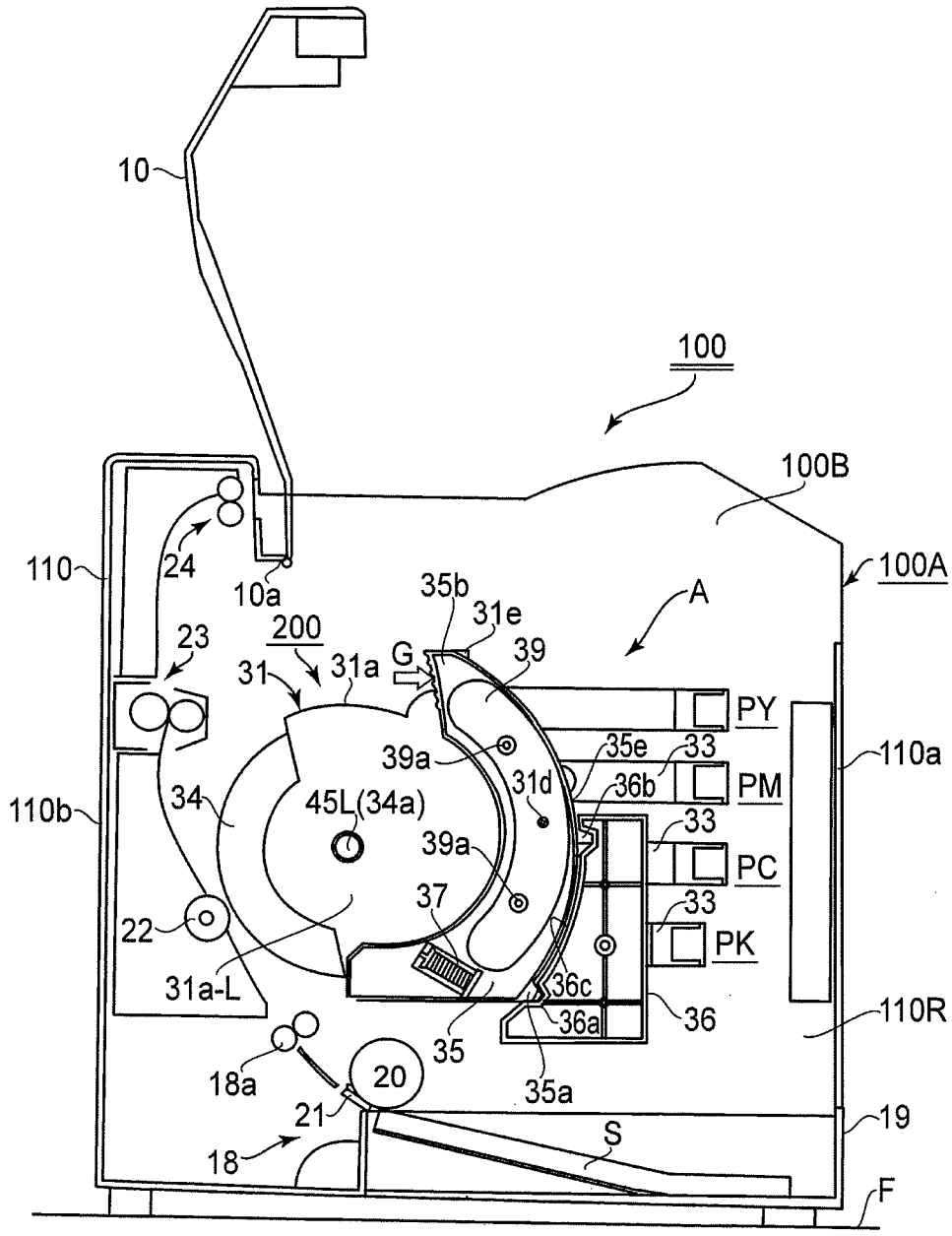
FIG. 7A is a left-hand side longitudinal sectional view of the image forming apparatus in the state that the cover is in the open position.

The developer contained in developing device 33*c* in each cartridge P (PY, PM, PC, PK) is consumed with the image forming operation. In view of this, for example, the means (unshown) for detecting a remaining amount of the developer of each developing cartridge 33 is provided. The control circuit portion 300 compares a detected remaining amount value with the threshold for a lifetime forenotice and a lifetime warning of the cartridge preset beforehand. The lifetime forenotice or the lifetime warning of the cartridge 33 is displayed on the display portion 102 of an operating portion 101 or a display (400) of an external host device of the image forming apparatus 100 for the cartridge 33 exhibiting the detected remaining amount value less than the threshold. This prompts a preparation of the developing cartridge for the exchange to the user, or prompts the exchange of the developing cartridge. In the image forming apparatus 100 of this embodiment, in an exchange of each developing cartridge 33 mounted to the unit 200, the opening 100B of the top side of the main assembly 100A is opened. Then, the user manually operates a grip portion 10*d* of the cover 10, to sufficiently rotate the cover 10 to the predetermined open position for opening the opening portion 100B from the closing position for closing the opening 100B about the hinge shaft 10*a*. FIG. 6B and FIG. 7A are a right-hand side longitudinal sectional view and a left-hand side longitudinal sectional view of the image forming apparatus 100 in the state that the cover 10 is opened to a predetermined open position. When the cover 10 is opened to the predetermined open position, the open state is maintained by locking means (unshown). By this, even if the user lifts the hand from the cover 10 thereafter, the cover 10 returns automatically and is not rotated. As for the locking means, the proper means of a click stop mechanism, for example, or the like can be used. By the interrelating mechanism (unshown) in interrelation with the partially opening rotation of the cover 10, the coupling of the drive outputting portion of the main assembly side with the drive inputting portion of the transfer member 34 is released. The coupling of the drive outputting portion of the main assembly (100A) side with the photosensitive unit 32 of each cartridge and the drive inputting portion of the developing cartridge 33 is released. The electrical connection of the electric power supply system in the main assembly (100A) with the photosensitive unit 32 and the electrical contact of the developing cartridge 33 are released. By the cover 10 being opened, the opening portion 100A is opened greatly. By this, in the main assembly 100A, the top side of the unit 200 placed in the transfer position A is exposed. The top ends 35*b* of the handle 31*e* and the lever 35 which are in the left-hand end portion of the top side of the frame 31 are exposed, so that the user can access the handle 31*e* thereof and the top end 35*b*.

Figure 7B:
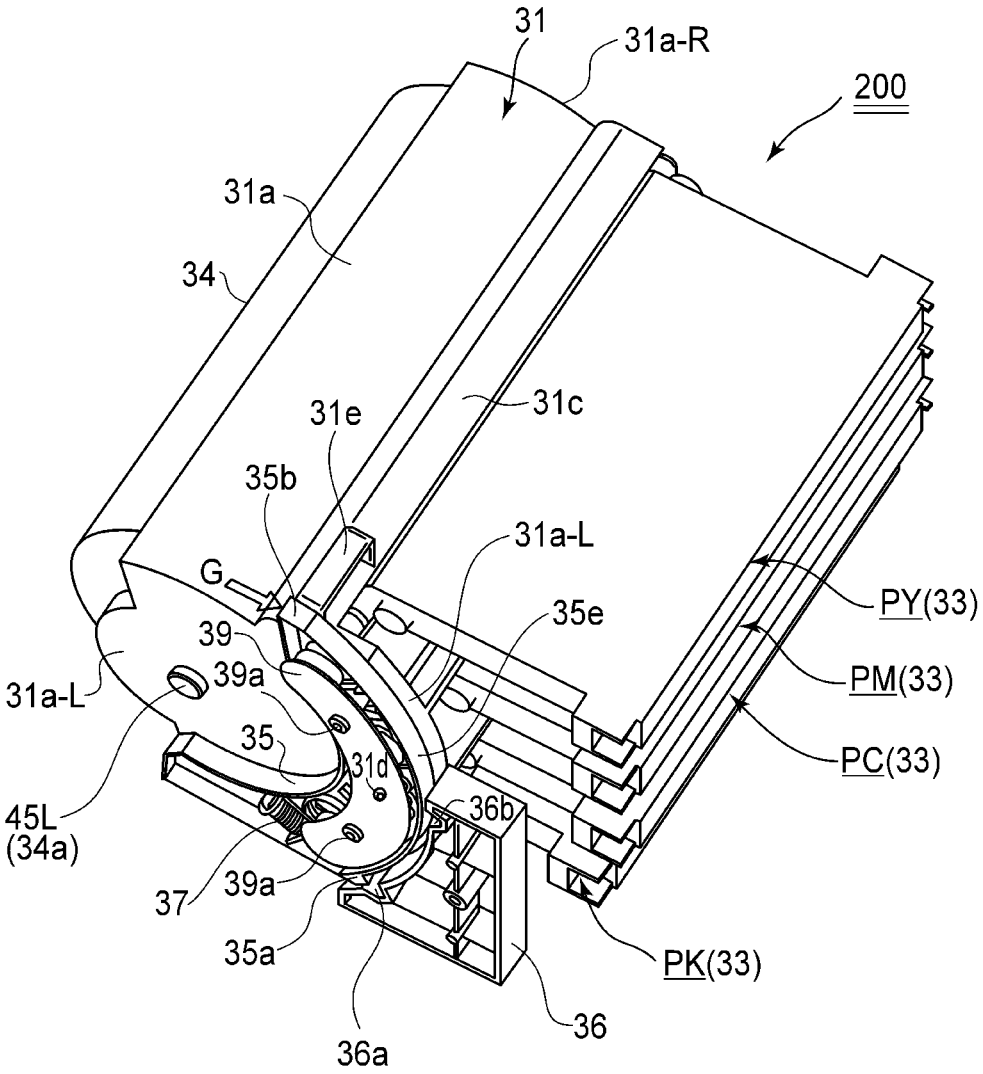
FIG. 7B is a perspective view of the image forming unit in the state that the locking of the image forming unit relative to a main assembly is released by a locking lever being operated in a lock releasing direction.
Figure 8B:
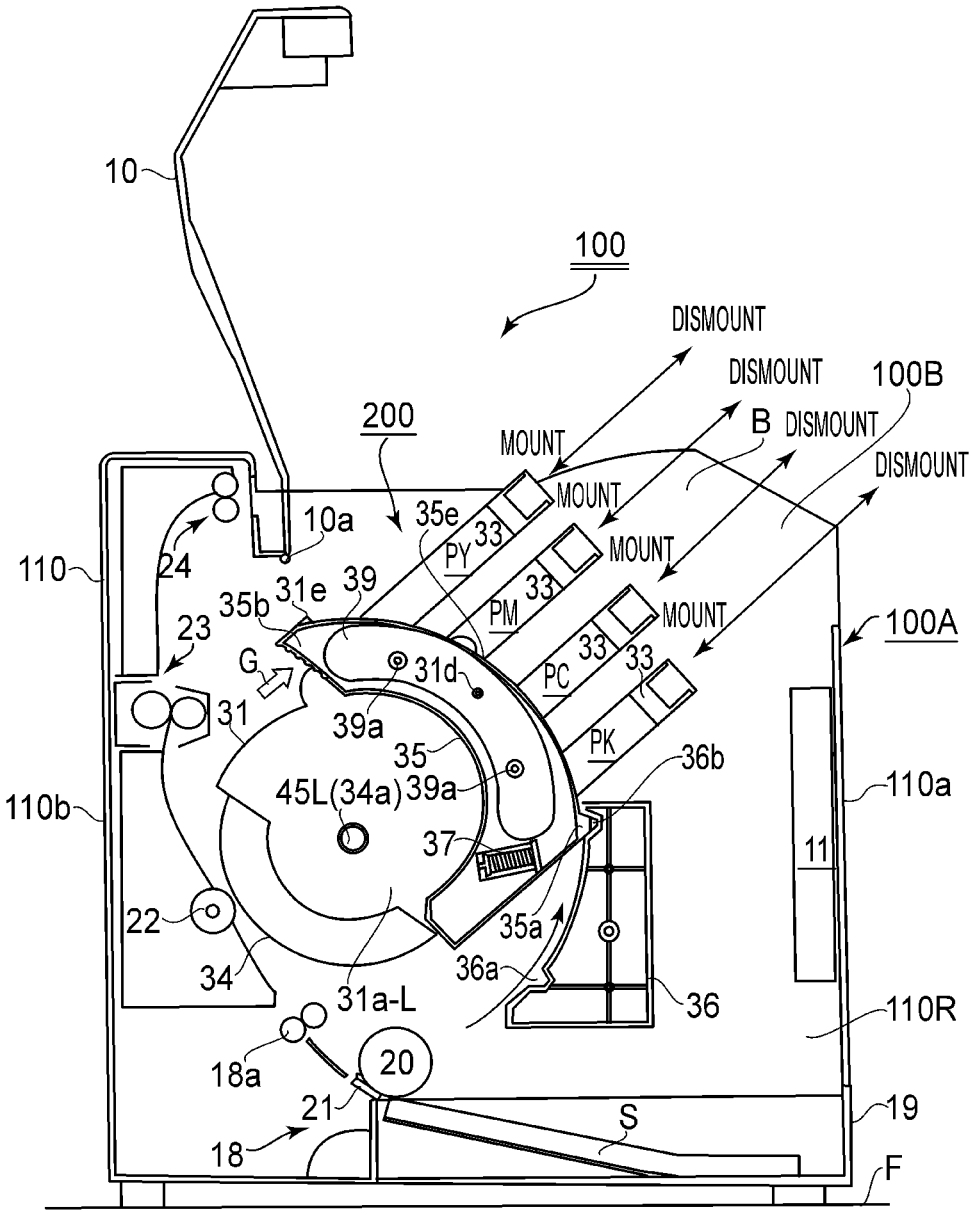
FIG. 8B is a left-hand side longitudinal sectional view of the image forming apparatus in the state that the image forming unit is in the mounting and dismounting position.

In view of this, the user catches the left hand or the right hand on the handle 31*e* and the top end 35*b*, and first, the user pushes the top end 35*b* of the lever 35 in the direction (front side) of an arrow G of FIG. 7A. By this, the lever 35 is rotated in the clockwise direction in FIG. 7A about the boss 31*d* against elasticity of the compression spring 37. As shown in FIG. 7B, by this, the projection 35*a* of the bottom end of the lever 35 separates from the first recess 36*a* of the locking base 36, so that the locking relative to the main assembly 100A of the unit 200 in the transfer position A is released. In this state, the user pushes the handle 31*e* rearwardly to rotate the unit 200 manually in the clockwise direction in FIG. 7A and the counter-clockwise direction in FIG. 6B about the shaft portions 45L, 45R. After slightly rotating the unit 200, a pressing force, in a direction of the arrow G, of the top end 35*b* of the lever 35 is released. The projection 35*a* of the bottom end of the lever 35 is normally rotationally urged by the spring force of the compression spring 37 about the boss 31*d* toward the base 36. By this, the projection 35*a* disengaging from the first recess 36*a* is in contact with the concave surface 36*c* of the base 36. In this state, the unit 200 is continuously rotated in the counter-clockwise direction in FIG. 7A. By this, the projection 35*a* is moved toward the upside second recess 36*b*, while sliding on the concave surface 36*c*. When the unit 200 is rotated in the clockwise direction in FIG. 7B by approx. 45 degrees from the transfer position A, the projection 35*a* of the lever 35 reaches the second recess 36*b* of the upper portion of the base 36. The projection 35*a* elastically engages with a recess 36*b* with a click feeling. The user rotates the unit 200 until this click feeling is provided. By this, the unit 200 rotates upwardly by approx. 45 degrees from the transfer position A of FIG. 6B and FIG. 7A to shift the cartridge 33 to an angular attitude faced to the opening portion 100B (FIG. 8A, FIG. 8B). This angular attitude is temporarily confined by the engagement between the projection 35*a* and the second recess 36*b*. In other words, the unit 200 rotates to the mounting and dismounting position B for mounting and demounting the cartridge 33 relative to the mounting portion 31*c*, and the dismounting of the cartridge 33 from the opening portion 100B is enabled. In the state that the unit 200 is placed in a mount position B, each cartridge 33 is pulled out against the urging force by the compression spring 40 of the plunger 38 from the mounting portion 31*c* upwardly and obliquely. By this, each cartridge 33 can be dismounted from the mounting portion 31*c*. On the contrary, in the state that the unit 200 is placed in the mount position B, each cartridge 33 is inserted angularly downwardly against the urging force by the compression spring 40 of the plunger 38 into the mounting portion 31*c*. By this, each cartridge 33 can be mounted to the mounting portion 31*c*. By the structure described above, the cartridge 33 can be exchanged without retracting the scanner unit 11. By this, the user can exchange the cartridge 33 easily.

Figure 9A:
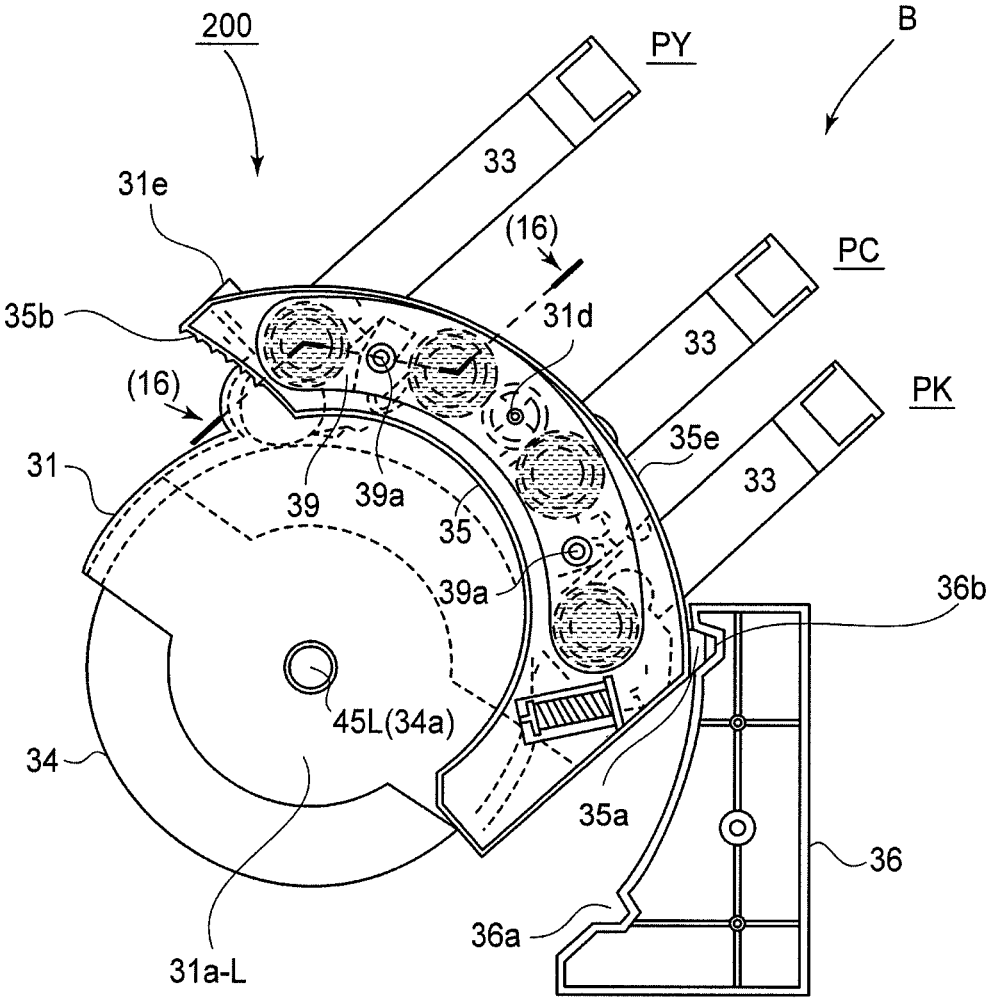
FIG. 9A is a left side view of the image forming unit in the state that it is in the mounting and dismounting position and in which the developing cartridge of the second cartridge is dismounted.
Figure 9B:
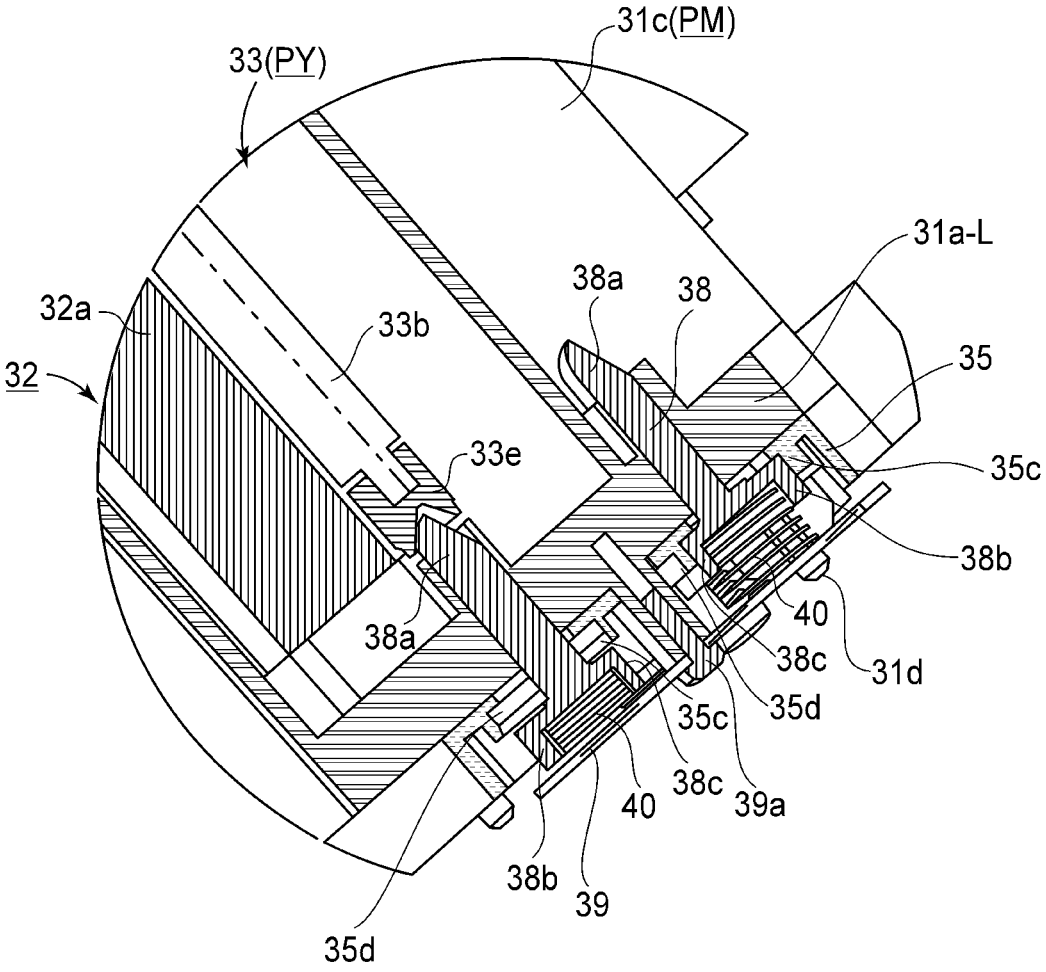
FIG. 9B is an enlarged cross-sectional view taken along (16)-(16) of FIG. 9A.

FIG. 9A illustrates the state that the unit 200 is placed in the mounting and dismounting position B and the cartridge 33 of the second cartridge PM is dismounted. FIG. 9B is an enlarged cross-sectional view taken along (16)-(16) of FIG. 9A. The plunger 38 of each mounting portion 31*c* is urged by the compression spring 40. The plunger 38 of the mounting portion 31*c* which does not have the cartridge 33 is not in engagement with the development bearing 33*e* of the cartridge (33) side. Therefore, the plunger 38 is advanced by the spring force of the compression spring 40. The flange 38*b* of the plunger 38 engages with the recess 35*c* of the lever (35), so that the plunger 38 stops. In this state, the rotation of the lever 35 about the boss 31*d* is prohibited by an outer periphery 38*c* of the flange 38*b* abutting to an inner surface 35*d* of the recess 35*c* of the locking lever (35). In more detail, in the state that the unit 200 is placed in the mounting and dismounting position B, when even one of the cartridges 33 mounted to the mounting portions 31*c* is taken out, the unit 200 is locked by the mounting and dismounting position locking member relative to the main assembly 100A in the mounting and dismounting position B. According to this embodiment, the mounting and dismounting position locking mechanism is constituted by a flange 38*b* (locking portion) of the plunger (38) and a recess 35*c* (locking portion) of the lever (35). By the structure described above, the engagement between the projection 35*a* and the second recess 36*b* is maintained, so that the user is prevented from closing the unit 200 inadvertently in the exchange of the cartridge 33. Therefore, in the mounting and demounting of the cartridge 33, it does not occur that the cartridge 33 is nipped between the opening portion 100B of the main assembly 100A and the unit 200.

When the cartridge 33 is mounted to the mounting portion 31*c* which does not have the cartridge 33, the development bearing 33*e* contacts to the free end portion 38*a* of the plunger 38, by which the plunger 38 retracts against the spring force of the compression spring 40. By this, flange (locking portion) 38*b* disengages from the recess (locking portion) 35*c* of the lever (35). In more detail, the unit 200 is released from the lock relative to the main assembly 100A by mounting and dismounting position locking members 38*b*, 35*c*. The free end portion 38*a* of the plunger 38 presses the inclined surface of the bearing 33*e*. By this, to the photosensitive drum 32*a*, the spacer 33*s* of the developing roller 33*b* is in contact ((a) of FIG. 3) or the developing roller 33*b* is in contact ((b) of FIG. 3). Thus, the cartridge 33 is positioned relative to the mounting portion 31*c*, and is stably supported there. When the cartridges 33 are mounted to all the mounting portions 31*c*, the mounting and dismounting position locking members 38*b*, 35*c* release the lock of the unit 200 relative to the main assembly 100A. In this state, the user catches the handle 31*e* and the lever 35 of the unit 200 temporarily confined by temporary confinement members 35*a*, 36*b* to the mounting and dismounting position B with the left hand or right hand at the top end 35*b* thereof. First, the user pulls the top end 35*b* of the lever 35 to the front (arrow G of FIG. 8A). In more detail, the user rotates the lever 35 about the boss 31*d* against the elasticity of the compression spring 37 (clockwise direction in FIG. 8B). By this, the projection (locking portion) 35*a* of the bottom end of the lever 35 disengages from the second recess (locking portion) 36*b* of the base 36. By this, the temporary confinement by the temporary confinement members 35*a*, 36*b* relative to the main assembly 100A in the mounting and dismounting position B of the unit 200 is released. In the released state, the user pulls the handle 31*e* to the front to rotate the unit 200 manually about the shaft portions 45L, 45R in the counter-clockwise direction in FIG. 8A, and in the clockwise direction in FIG. 8B. After rotating slightly the unit 200, the pressing, in the direction of the arrow G, of the top end 35*b* releases. The lever 35 is normally rotationally urged by the spring force of the compression spring 37 which presses against the projection 35*a* about the boss 31*d* toward the base 36. By this, the projection 35*a* having disengaged from the second recess 36*b* is in contact with the concave surface 36*c* of the base 36. In this state, the unit 200 is continuously rotated (clockwise direction in FIG. 8B). By this, while the projection 35*a* slides along the concave surface 36*c* of the locking base 36, it is moved toward the lower recess 36*a*. When the unit 200 is rotated by approx. 45 degrees from the mounting and dismounting position B (clockwise direction in FIG. 8B), the projection 35*a* of the lever 35 reaches a recess 36*a*. The projection (locking portion) 35*a* engages into the recess (locking portion) 36*a*. This provides the click feeling. The user rotates the unit 200 until this click feeling is provided. By this, the unit 200 rotates by approx. 45 degrees from the mounting and dismounting position B (FIG. 8A, FIG. 8B) to return to the previous transfer position A (FIG. 6B, FIG. 7A). The angular attitude is maintained by the engagement between the projection 35*a* and the recess 36*a*. Thereafter, the user rotates the cover 10 in the closed position manually. By the interrelating mechanism (unshown) in interrelation with a closing operation of the cover 10, the drive outputting portion of the main assembly side couples with the drive inputting portion of the transfer member 34. The drive outputting portions of the main assembly (100A) side are coupled to the drive inputting portions of each of the photosensitive units 32 and each of the developing cartridges 33. The electrical contacts of the unit 32 and the cartridge 33 are electrically connected to the electric power supply system in the main assembly (100A) side. By this, the image forming apparatus 100 returns to the state shown in FIGS. 2A and 5B to enable the image forming operation.

Figure 10A:
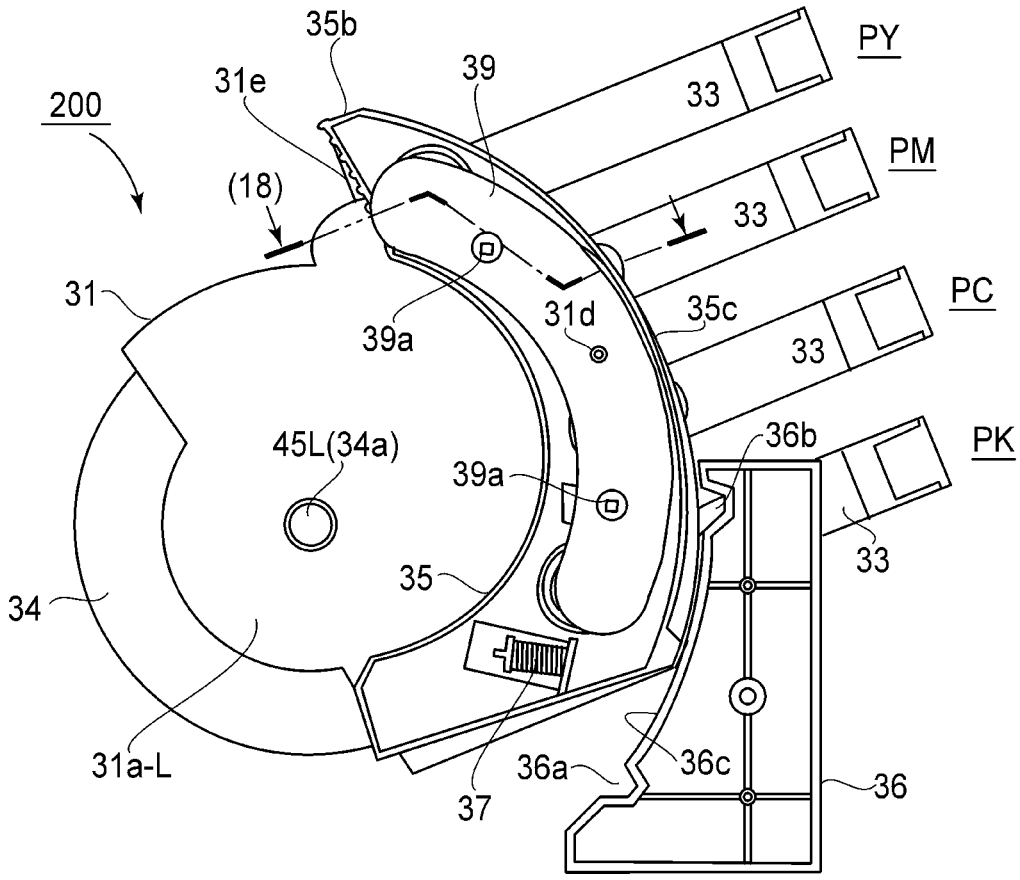
FIG. 10A is a left side view of the image forming unit partway of returning from the mounting and dismounting position to the transfer position.
Figure 10B:
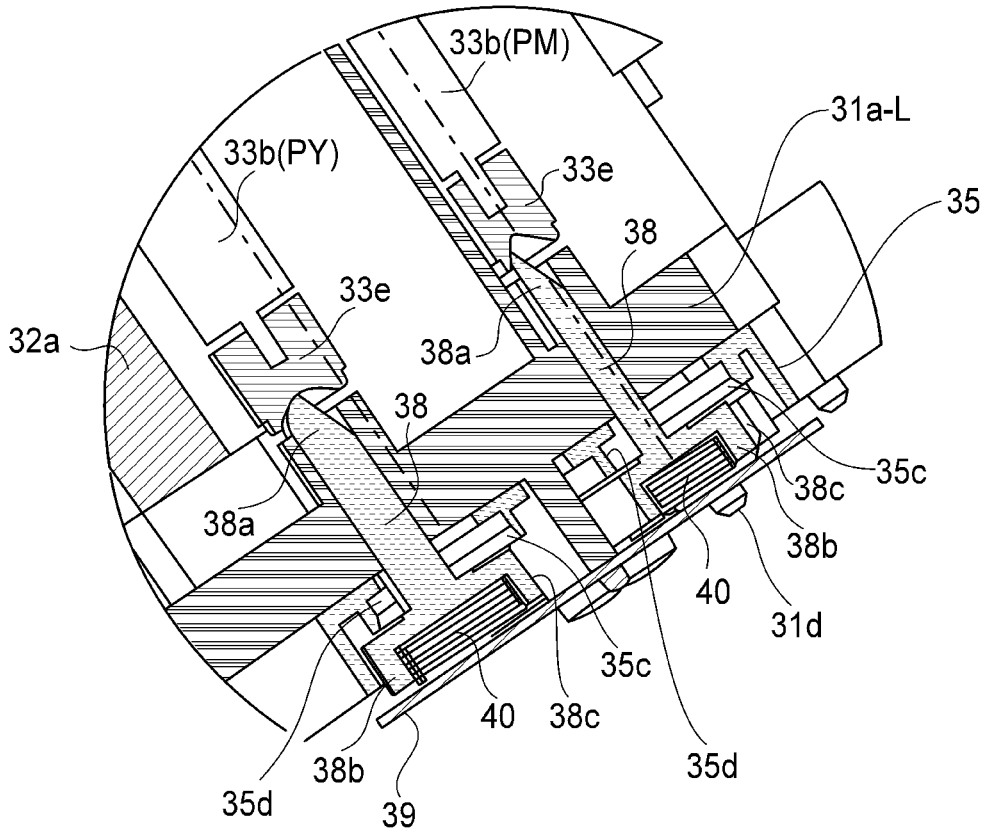
FIG. 10B is an enlarged cross-sectional view taken along (18)-(18) of FIG. 10A.
Figure 11:
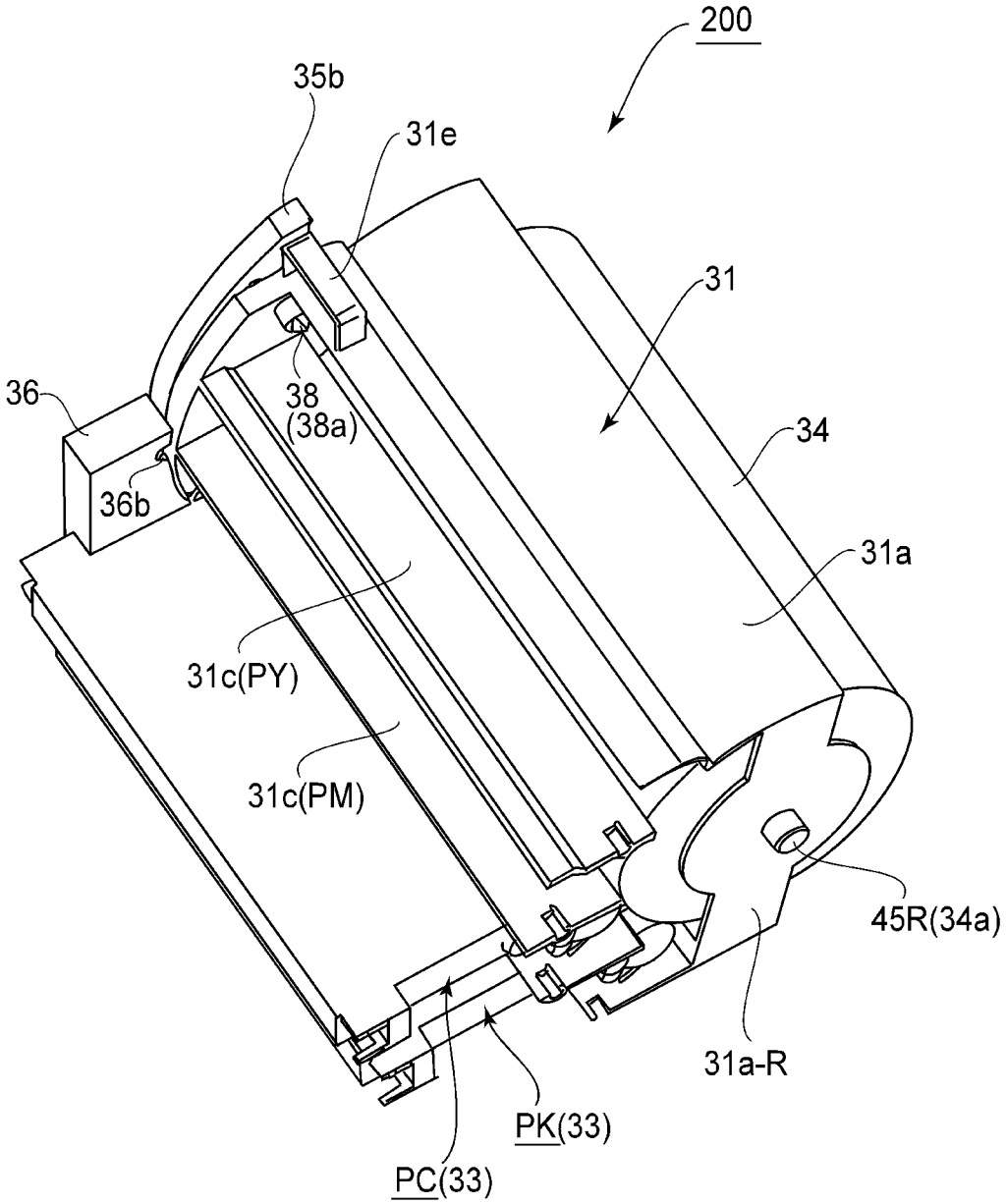
FIG. 11 is an illustration of a releasing member which releases the lock made by a mounting and dismounting position locking member.

FIG. 10A illustrates the state in the course of the unit 200 being returned from the mounting and dismounting position B to the transfer position A. FIG. 10B is an enlarged cross-sectional view taken along (18)-(18) of FIG. 10A. As shown in FIG. 10B, when the cartridge 33 is in the mounting portion 31*c*, the plunger 38 is pushed against the compression spring 40. By this, a flange portion (locking portion) 38*b* is exposed from the recess (locking portion) 35*c*. For this reason, the lever 35 can be rotated. As shown in FIG. 10A, the projection 35*a* of the locking lever 35 urged by the compression spring 37 has a sliding resistance relative to a surface 36*c* of the base 36, and therefore the movement of the unit 200 is retarded. Therefore, when the user returns the unit 200 from the mounting and dismounting position B to the transfer position A, the unit 200 is moved with a suppressed impact. FIG. 11 is a right perspective view of the unit 200 from which the developing cartridges 33 of the first cartridge PY and the second cartridge PM are dismounted. In the manufacturing and service of the image forming apparatus 100, it may be required that even if the cartridge 33 is not mounted, the unit 200 is returned to the transfer position A. In such an occasion, while the plungers 38 which project into the inside of a mounting portion from the first-fourth mounting portions (developing device coupling units) 31*c* are pushed, the unit 200 is rotated. In this manner, even if the cartridge is not mounted to the mounting portion 31*c*, a releasing member 38 is provided and it releases the lock by the mounting and dismounting position locking members 38*b*, 35*c*. By the user operating the releasing member 38 thereof manually, the lock by the mounting and dismounting position locking members 38*b*, 35*c* can be released.

The structure of the image forming apparatus 100 of the above-described embodiment is summarized as follows. The apparatus is an electrophotographic color image forming apparatus 100 for forming a color image on recording material S. It includes two or more cartridge mounting portions 31*c* for mounting the cartridge 33 dismountably. It further includes a single transfer member 34 opposed to drums 32*a*, and the developer images formed on the drums 32*a* are transferred onto the transfer member. The apparatus includes an image forming unit 200 including two or more cartridge mounting portions 31*c* and the transfer member 34. The unit 200 is movable between the transfer position A for transferring the developer image transferred onto the transfer member 34 from drums 32*a* onto the recording material S, and the mounting and dismounting position B for mounting and demounting the cartridge 33 relative to the mounting portion 31*c*. In the state that the unit 200 is placed in the mounting and dismounting position B, the cartridges 33 are taken out of the mounting portions 31*c*. The mounting and dismounting position locking members 38*b*, 35*c* for locking the unit 200 relative to the main assembly 100A in the mounting and dismounting position B are provided when even one of the cartridges 33 is taken out of the mounting portion 31*c*. Furthermore, the temporary confinement members 35*a*, 36*b* for temporarily confining the unit 200 in the mounting and dismounting position B are provided when the unit 200 moves from the transfer position A to the mounting and dismounting position B. The user takes out a first cartridge from the unit 200 temporarily confined in the mounting and dismounting position B by the temporary confinement members 35*a*, 36*b*. When the cartridges 33 are mounted to all the mounting portions 31*c*, locking members 38*b*, 35*c* release the unit 200 relative to the main assembly 100A. The cartridge 33 mounted to the mounting portion 31*c* which does not have the cartridge 33 may be the very cartridge that has been dismounted from the mounting portion 31*c*. Or, it may be a different cartridge 33. By the mounted cartridge, the lock by the mounting and dismounting position locking members 38*b*, 35*c* is released. Furthermore, the transfer position locking members 35*a*, 36*a* for locking the unit 200 relative to the main assembly 100A is provided in the transfer position A.

The unit 200 is movable between the transfer position A and the mounting and dismounting position B by the user's manual operation. Furthermore, even if the cartridge 33 is not mounted to the mounting portion 31*c*, the lock by the locking members 38*b*, 35*c* can be released by the releasing member 38. The lock by the locking members 38*b* and 35*c* can be released by the user operating the releasing member 38 manually. The unit 200 is moved between the mounting and dismounting position B and the transfer position A about the rotation axis 34*a* of the transfer member 34. A plurality of drums 32*a* are provided in the unit 200. In this embodiment, the cartridge 33 is a developing cartridge which is provided with the developing roller 33*b* for developing the electrostatic latent image formed on the drum 32*a*. The cartridge 33 is mounted to the mounting portions 31*c*, so that the developing roller 33*b* is placed opposed to the drums 32*a*, respectively. In the state that the unit 200 is placed in transfer position A, the developing roller 33*b* develops the electrostatic latent image in the state that it is spaced with the gap x from the drum 32*a*. According to the embodiments, the mounting and dismounting operativity of the cartridge 33 to the main assembly 100A can be improved. Furthermore, the color electrophotographic image forming apparatus can be provided in which at the time of the mounting and dismounting of the cartridge, the cartridge can be replaced without retracting the scanner unit (image exposure device) 11. The color electrophotographic image forming apparatus can be provided, wherein at the time of the mounting and demounting of the cartridge 33, the cartridge 33 is not nipped between the opening portion 100B of the main assembly and the image forming unit 200.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 048102/2009 filed Mar. 2, 2009, which is hereby incorporated by reference herein.

What is claimed is:

1. A color electrophotographic image forming apparatus for forming a color image on a recording material, comprising:

a plurality of cartridge mounting portions for demountably mounting cartridges, the cartridges being independently removable and mountable;

a single intermediary transfer member provided opposed to a plurality of electrophotographic photosensitive member drums, wherein developed images formed on said electrophotographic photosensitive member drums are to be transferred;

an image forming unit including said cartridge mounting portions and said intermediary transfer member, wherein said image forming unit is movable between a transfer position for transferring to the recording material a developed image transferred onto said intermediary transfer member from said electrophotographic photosensitive member drums and a mounting and demounting position for mounting and demounting any one or more of a plurality of the cartridges relative to the corresponding one of said plurality of cartridge mounting portions; and a mounting and demounting position locking member for locking said image forming unit to prevent movement relative to a main assembly of said color electrophotographic image forming apparatus to the transfer position when at least one of the plurality of cartridges is not mounted in the corresponding one of said plurality of cartridge mounting portions, in a state in which said image forming unit is placed in the mounting and demounting position, wherein said mounting and demounting position locking member is movable from an unlocking position to a locking position in interrelation with demounting of any one of the cartridges from its corresponding cartridge mounting portion, and wherein said mounting and demounting position locking member is moved to the unlocking position when all of the plurality of cartridges are mounted in the corresponding plurality of cartridge mounting portions.

2. An apparatus according to claim 1, further comprising a temporary confining member for temporarily confining said image forming unit to the mounting and demounting position when said image forming unit is moved from the transfer position to the mounting and demounting position, wherein a first one of the cartridges is manually taken out of said image forming unit in the state that said image forming unit is temporarily confined to the mounting and demounting position by said temporary confining member.

3. An apparatus according to claim 1, wherein when all of the plurality of cartridges are mounted to said cartridge mounting portions, respectively, said mounting and demounting position locking member is moved to the unlocking position so as to release locking of said image forming unit from the main assembly of the apparatus.

4. An apparatus according to claim 3, wherein said mounting and demounting position locking member releases the locking irrespective of whether any one of the plurality of cartridges mounted to a corresponding one of said plurality of cartridge mounting portions is the very cartridge that has been removed or a different cartridge.

5. An apparatus according to claim 1, further comprising a transfer position locking member for locking said image forming unit in the transfer position relative to the main assembly of the apparatus.

6. An apparatus according to claim 1, wherein said image forming unit is manually movable between the transfer position and the mounting and demounting position.

7. An apparatus according to claim 1, further comprising a releasing member for manually releasing the locking of said mounting and demounting position locking member when any combination of the plurality of cartridges is not mounted in corresponding cartridge mounting portions.

8. An apparatus according to claim 1, wherein said image forming unit is rotatable about a rotation axis of said intermediary transfer member between the mounting and demounting position and the transfer position.

9. An apparatus according to claim 1, wherein the electrophotographic photosensitive member drums are provided in said image forming unit, and the cartridges are developing cartridges each including a developing roller for developing an electrostatic latent image formed on a corresponding one of the electrophotographic photosensitive member drums, wherein the developing cartridges are mounted to said cartridge mounting portions such that each developing roller is opposed to a corresponding one of the plurality of electrophotographic photosensitive member drums, and wherein the electrostatic latent image is developed with each developing roller spaced from the corresponding one of the plurality of electrophotographic photosensitive member drums in a state in which said image forming unit is positioned in the transfer position.

* * * * *